US007867115B2

(12) United States Patent
Zawitz

(10) Patent No.: US 7,867,115 B2
(45) Date of Patent: Jan. 11, 2011

(54) SEGMENTED BALL WITH LIGHTED ELEMENTS

(75) Inventor: Richard E. Zawitz, South San Francisco, CA (US)

(73) Assignee: Tangle, Inc., San Francisco, CA (US)

( * ) Notice: Subject to any disclaimer, the term of this patent is extended or adjusted under 35 U.S.C. 154(b) by 217 days.

(21) Appl. No.: 11/957,904

(22) Filed: Dec. 17, 2007

(65) Prior Publication Data

US 2009/0156092 A1 Jun. 18, 2009

(51) Int. Cl.
*A63B 37/00* (2006.01)

(52) U.S. Cl. ..... 473/570; 473/612; 446/175; 446/438; 446/439

(58) Field of Classification Search ..... 473/570, 473/571, 612; 446/91, 175, 438, 439
See application file for complete search history.

(56) References Cited

U.S. PATENT DOCUMENTS

| | | | | |
|---|---|---|---|---|
| 115,252 | A | 5/1871 | Spencer | |
| 513,560 | A | 1/1894 | Dickey | |
| 1,611,488 | A | 12/1926 | Rocquin et al. | |
| 1,852,071 | A | 4/1932 | Becker | |
| 2,073,346 | A | 3/1937 | Clow | |
| 2,078,382 | A | 4/1937 | Hanshaw | |
| 2,703,724 | A | 3/1955 | Der Yuen et al. | |
| 2,791,868 | A | 5/1957 | Viken | |
| 2,985,976 | A | 5/1961 | Parker | |
| 3,046,016 | A | 7/1962 | Laws | |
| D202,549 | S | 10/1965 | Kramer | |
| D202,550 | S | 10/1965 | Kramer | |
| 3,218,071 | A | 11/1965 | Richard | |
| 3,222,072 | A | 12/1965 | Dreyer | |
| 3,238,586 | A | 3/1966 | Stoffel | |
| 3,251,103 | A | 5/1966 | Saut | |
| 3,469,339 | A | 9/1969 | Thomas | |
| 3,514,893 | A | 6/1970 | Paksy | |
| 3,521,596 | A | 7/1970 | Schlein | |
| D219,284 | S | 11/1970 | Hunt | |
| D220,388 | S | 4/1971 | Kramer | |
| 3,597,872 | A | 8/1971 | Vennola et al. | |
| 3,633,587 | A | 1/1972 | Hunt | |
| 3,656,808 | A | 4/1972 | Chang | |
| 3,884,462 | A | 5/1975 | Rebajes | |
| 3,889,950 | A * | 6/1975 | Kasravi | 473/612 |

(Continued)

FOREIGN PATENT DOCUMENTS

| | | |
|---|---|---|
| DE | 2503780 | 5/1976 |

(Continued)

*Primary Examiner*—Gene Kim
*Assistant Examiner*—Joseph B Baldori
(74) *Attorney, Agent, or Firm*—Townsend and Townsend and Crew LLP

(57) ABSTRACT

Embodiments of the instant invention include lighted bounceable toys for play and amusement. Such toys or structures can be made in an infinite number of graceful and useful configurations. Exemplary bounceable ball toys include a light assembly having a power source and a plurality of light emitting elements, and a spherical skeletal structure having a plurality of segments. The spherical skeletal structure defines an open interior cavity, and at least some segments of the skeletal structure include a channel opening that faces toward the interior cavity. Light emitting elements transmit light to the channel openings.

13 Claims, 23 Drawing Sheets

U.S. PATENT DOCUMENTS 3,900,984 A 8/1975 Garelick
3,977,683 A 8/1976 Tomura
4,012,155 A 3/1977 Morris
D244,643 S 6/1977 Deaton et al.
4,031,635 A 6/1977 Brandt et al.
4,071,244 A 1/1978 Richards
4,106,657 A 8/1978 Dogliotti
D251,942 S 5/1979 VonHeck
4,179,832 A 12/1979 Lemelson
4,184,271 A 1/1980 Barnett, Jr.
D255,183 S 6/1980 Locher
D255,184 S 6/1980 Locher
D255,185 S 6/1980 Locher
4,214,747 A 7/1980 Rebajes
4,232,473 A 11/1980 Jenkins
4,259,821 A 4/1981 Bush
4,274,222 A * 6/1981 Zahn et al. ..... 446/126
4,305,582 A 12/1981 Barton
4,325,698 A 4/1982 Darling et al.
D264,365 S 5/1982 Arino
D265,573 S 7/1982 Clarke
4,362,031 A 12/1982 Obermuller
4,377,916 A 3/1983 Komiya
4,509,929 A 4/1985 Zawitz
4,637,941 A 1/1987 Rochte
4,650,424 A 3/1987 Mitchell
4,652,248 A 3/1987 Kozuka
4,778,184 A 10/1988 Fleischer
D298,957 S 12/1988 Van, Jr.
4,850,927 A 7/1989 Caranica
D307,221 S 4/1990 Mudge
4,915,666 A * 4/1990 Maleyko ..... 446/242
4,930,776 A * 6/1990 Newcomb et al. ..... 473/570
4,935,995 A 6/1990 Daus, Jr.
4,974,844 A 12/1990 Richards
5,018,252 A 5/1991 Butler
D318,506 S 7/1991 Caranica
5,110,315 A 5/1992 Zawitz
5,224,959 A 7/1993 Kasper
D355,230 S 2/1995 Brown
5,564,702 A * 10/1996 Meffert ..... 273/153 R
5,639,076 A * 6/1997 Cmiel et al. ..... 473/570
D385,002 S 10/1997 Schloss
5,676,611 A 10/1997 Foster et al.
D390,019 S 2/1998 Lee
5,725,445 A * 3/1998 Kennedy et al. ..... 473/570
5,823,843 A * 10/1998 Pohlman ..... 446/120
D407,869 S 4/1999 Wang
6,003,470 A 12/1999 Budman
6,086,445 A 7/2000 Zawitz
6,089,939 A 7/2000 Dyson
6,220,980 B1 * 4/2001 Adler ..... 473/613
6,398,615 B1 6/2002 Wu et al.
6,482,071 B1 * 11/2002 Wilgosz ..... 446/486
D469,484 S 1/2003 Dawson
D473,021 S 4/2003 Gourley
D475,487 S * 6/2003 DeAngelis ..... D30/160
D477,441 S 7/2003 Willinger et al.
D479,897 S 9/2003 Willinger
6,622,659 B2 9/2003 Willinger
6,651,590 B2 11/2003 Willinger et al.
6,716,082 B1 4/2004 Chen Pan
6,729,984 B2 5/2004 Silverglate
6,857,770 B2 2/2005 Moore
D511,029 S 10/2005 Willinger
D513,096 S 12/2005 Stiles
D514,263 S 1/2006 Willinger
7,192,328 B2 3/2007 Zawitz
D556,275 S 11/2007 Crane et al.
7,316,598 B1 1/2008 Lock
D562,419 S 2/2008 Crane et al.
D569,640 S 5/2008 Robson
D571,572 S 6/2008 Tseng
D576,235 S 9/2008 Zawitz
D583,113 S * 12/2008 Simon ..... D30/160
D595,516 S 7/2009 Zawitz
2003/0224885 A1 * 12/2003 Leal et al. ..... 473/570
2005/0009650 A1 * 1/2005 Sullivan, III ..... 473/570
2006/0014468 A1 1/2006 Zawitz
2006/0057932 A1 3/2006 Gick
2006/0084357 A1 * 4/2006 Rosen et al. ..... 446/91
2006/0280545 A1 12/2006 Zawitz
2007/0032319 A1 * 2/2007 Tufte ..... 473/570
2008/0090486 A1 4/2008 Zawitz

FOREIGN PATENT DOCUMENTS

FR 1195407 6/1959
GB 2259257 A 3/1993

* cited by examiner

SEGMENTED BALL WITH LIGHTED ELEMENTS

CROSS-REFERENCES TO RELATED APPLICATIONS

This application is related to U.S. Pat. Nos. 4,509,929, 5,110,315, and 6,086,445, and U.S. patent application Ser. Nos. 10/744,962 filed Dec. 23, 2003, 11/015,387 filed Dec. 16, 2004, 11/152,020 filed Jun. 13, 2005, and 11/558,350 filed Nov. 9, 2006, the entire contents of each of which are incorporated herein by reference.

BACKGROUND OF THE INVENTION

Embodiments of the invention relate generally to the field of toys, and in particular to devices and methods that involve lighted segments having curved or angular profiles. Embodiments of the present invention provide toys or objects for use as balls, therapeutic instruments, baby toys, pet toys, beach or pool rafts, and the like.

The incorporation of lighted features has provided the basis for a variety of toys and other useful objects. Although such toys and objects have been generally commercially successful, it would be desirable to provide certain innovations and diversifying features. For these and other reasons, there continues to be a need for improved toy systems and other useful and decorative structures. Embodiments disclosed herein provide solutions to such needs.

BRIEF SUMMARY OF THE INVENTION

Embodiments of the instant invention address these and other unfulfilled needs by providing systems, devices, and methods involving toys with lighted segments, which provide appealing stimulation to the visual and tactile senses. Such toys or structures can be made in an infinite number of graceful and decorative configurations. Moreover, these objects can function as bounceable, rollable, throwable, inflatable, or floatable devices, as diversion tranquilizers for occupying a user's hands and attention, and as toys for general amusement and artistic inspiration.

In one aspect, embodiments of the present invention include a bounceable ball toy. The toy includes a light assembly having a power source and a plurality of light emitting diodes. The toy also includes a spherical skeletal structure having a plurality of segments, where the spherical skeletal structure defining an open interior cavity. At least some segments of the skeletal structure have a channel opening that faces toward the interior cavity. The light emitting diodes are disposed at least partially within the channel openings. In some cases the spherical skeletal structure defines at least two apertures that provide fluid communication between the open interior cavity and an ambient space disposed outside of an external boundary defined by the skeletal structure. The light assembly may be configured to direct light toward a surface of the channel opening. In some cases, at least some of the segments have a portion that is transparent or translucent to light. Optionally, the light assembly includes a wire that is disposed at least partially within the channel openings.

In another aspect, embodiments of the present invention encompass a bounceable ball toy that includes a light assembly and a skeletal structure. The skeletal structure may include a plurality of segments, and may define an open interior cavity. In some cases, one or more segments of the skeletal structure include a support. The light assembly can be configured to direct light into the supports. A support may include a channel, a lumen, a bulb, a tube, a passage, or the like. In some cases, a support includes a channel having a concave surface that faces toward the open interior cavity. In related cases, the light assembly is configured to direct light toward the concave surface of the channel. Optionally, the support may include a lumen, and the light assembly can have a light emitting element disposed within the lumen.

In still another aspect, embodiments of the present invention include a toy having a light assembly and a skeletal structure. The skeletal structure can have at least one segment, and can define an open interior cavity. The light assembly can be configured to direct light into at least one segment of the skeletal structure or into a core module disposed at least partially within the skeletal structure. In some cases, the light assembly includes a light emitting diode or a glowstick. In some cases, a segment or core module includes a channel, and the light assembly includes a light emitting diode or a glowstick configured to direct light toward or through a surface of the channel. Optionally, a segment or core module can have a lumen, and the light assembly can have a light emitting diode configured to direct light toward or through a surface of the lumen. The skeletal structure may define two or more apertures that provide fluid communication between the open interior cavity and an ambient space disposed outside of an external boundary defined by the skeletal structure. The skeletal structure may also define a shape such as a sphere, a spheroid, a prolate spheroid, an oblate spheroid, an ellipsoid, a toroid, a geodesic sphere, or the like. In some cases, a light assembly may include a processor. In some cases, the skeletal structure may be coupled with a logo plate. The logo plate can include a filter, an aperture, or any of a variety of translucent, transparent, or opaque components or materials. In some embodiments, a core module may have one or more struts. Optionally, a core module may include a platform. In some cases, a skeletal structure includes a thermoplastic resin having a durometer of about 60.

In yet another aspect, embodiments of the present invention encompass a method of making a bounceable ball toy. An exemplary method may include coupling a power source holder with a plurality of light emitting diodes to form a light assembly, and coupling the light assembly with a spherical skeletal structure having a plurality of segments. At least some segments of the skeletal structure may have a channel opening that faces toward an open interior cavity defined by the skeletal structure. A light emitting diode may be disposed at least partially within a channel opening. The method may also include placing a power source in operative association with the power source holder. In some methods, a skeletal structure segment may include a material that is transparent or translucent to light. In some methods, a power source holder can be attached with a skeletal structure segment.

According to some aspects, embodiments of the present invention include a method of making a toy that includes, for example, providing a light assembly, and coupling the light assembly with a skeletal structure. The skeletal structure may define an open interior cavity. In some methods, the skeletal structure defines two or more apertures that provide fluid communication between the open interior cavity and an ambient space disposed outside of an external boundary defined by the skeletal structure. In some methods, the skeletal structure includes a channel facing toward the open interior cavity, and the light assembly is configured to direct light toward the channel. Optionally, the skeletal structure may include a lumen, and the light assembly can be configured to illuminate an interior space of the lumen. In some methods, the skeletal structure includes a portion that is transparent or translucent to light. According to certain method embodiments, the light assembly includes a glowstick, or a power source holder having connectivity with a plurality of light emitting elements.

For a fuller understanding of the nature and advantages of the present invention, reference should be had to the ensuing detailed description taken in conjunction with the accompanying drawings.

BRIEF DESCRIPTION OF THE DRAWINGS

FIGS. 15A-1 and 15A-2 show aspects of a toy according to embodiments of the present invention.

FIGS. 15B-1 and 15B-2 show aspects of a toy according to embodiments of the present invention.

FIGS. 15C-1 and 15C-2 show aspects of a toy according to embodiments of the present invention.

DETAILED DESCRIPTION OF THE INVENTION

Figure 1:
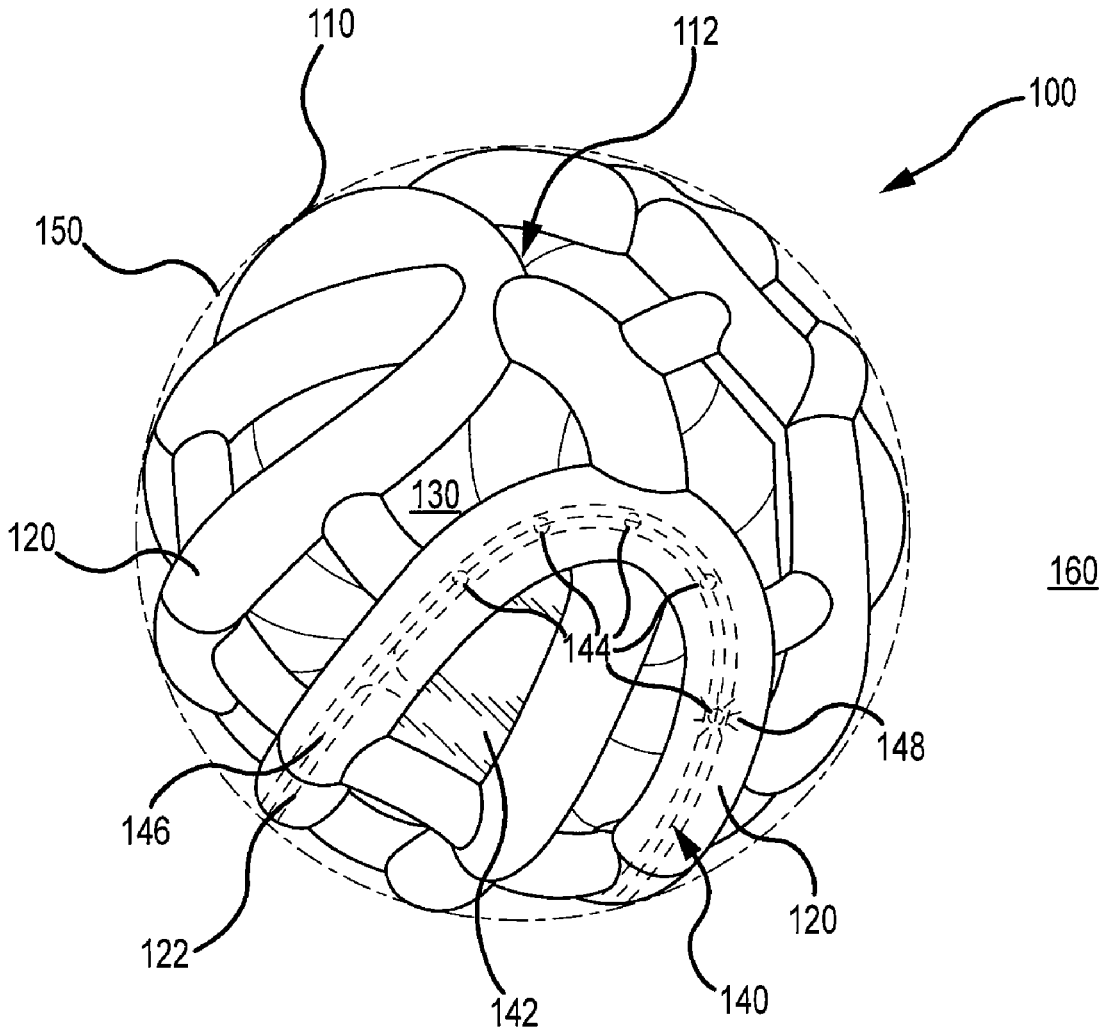
FIG. 1 illustrates a perspective view of a toy according to embodiments of the present invention.

Turning now to the drawings, FIG. 1 illustrates a perspective view of a toy according to embodiments of the present invention. Toy 100 includes a skeletal structure 110 having a plurality of segments 120. Skeletal structure 110 defines an open interior cavity 130. Typically, open interior cavity 130 is in fluid communication with an ambient space or environment 160 disposed outside of the toy. As such, at some locations the segments themselves may provide a separation or boundary between interior cavity 130 and ambient space 160, whereas in other places there may be no physical barrier between the cavity and the ambient space. Hence, in some embodiments it may be helpful to describe a boundary envelope 150 that corresponds to, and in some cases is defined by, the skeletal structure. Boundary envelope 150 can have a shape similar to that of the skeletal structure. As shown in FIG. 1, boundary envelope 150 can have a generally spherical shape that corresponds to the spherical shape outline of skeletal structure 110. In a geometric sense, boundary envelope 150 can define an outer limit of open interior cavity 130, particularly in locations there is no physical separation between the interior cavity and the ambient space provided by the skeletal structure itself. Optionally, open interior cavity 130 may be in fluid communication with ambient space 160 via a plurality of apertures 112 which are defined by skeletal structure 110. Segments 120 can have supports 122 such as channels or lumens. As shown here, toy 100 also includes a light assembly 140 having a power source 142 and a plurality of light emitting diodes (LEDs) 144. Light assembly 140 includes a wire or conducting element 146 that conducts electricity between power source 142 and LEDs 144. Light assembly 140 can be configured to direct light 148 into a plurality of supports 122.

Figure 1A:
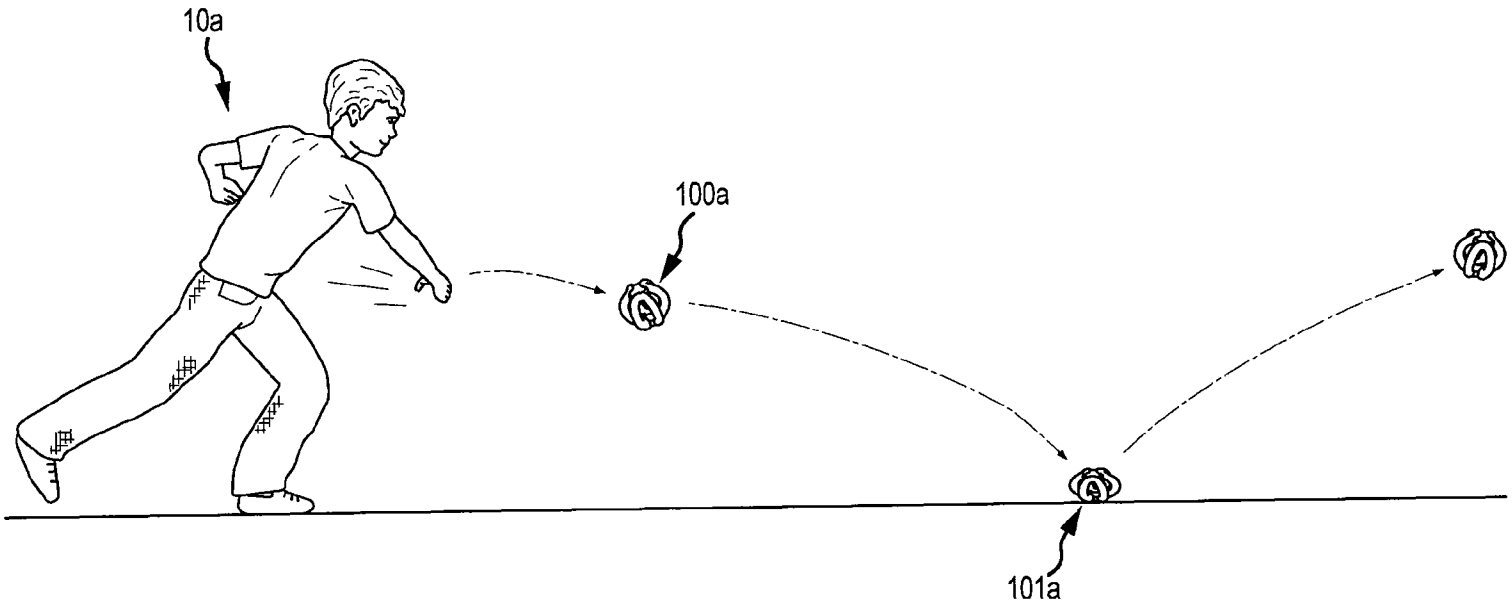
Figure 1B:
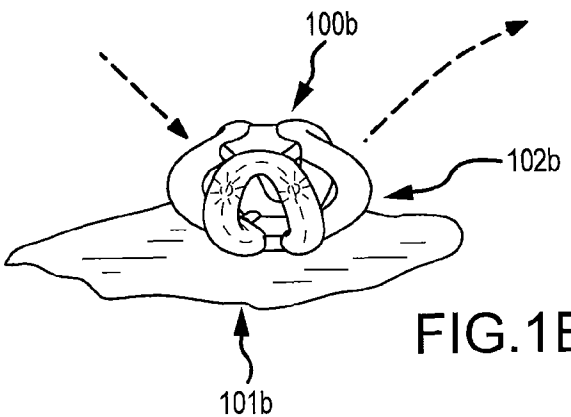

As shown in FIG. 1A, a toy operator 10*a* can throw a toy 100*a* toward a surface 101*a*. As toy 100*a* strikes surface 101*a*, the toy or portions thereof can elastically deform or deflect such that the toy subsequently bounces. FIG. 1B depicts an elastic deflection 102*b* of one or more segments of a toy 100*b* as it contacts or collides with surface 101*b*. Similarly, a user can hold the toy in their hand, and deform the toy by applying a compressive force. The application of force by the user provides strengthening for the hand and finger muscles as well as rehabilitation for the joints. Simultaneously, the operator may enjoy the visual display provided by the lighting assembly of the toy. One or more segments of the toy can be coated with any of a variety of materials. The coatings on the segments may be any type of color, may include translucent or transparent material, and may have a variety of thicknesses, textures, durometers, compression deflection pressures, and the like. Merely by way of example, the thickness of the coating may be in the range from about 1 mm to about 6 mm, and more preferably from about 2 mm to about 4 mm. Examples of textures that may be used include dots, detents, dimples, lines, roughened, smooth, sticky, and the like.

Figure 2:
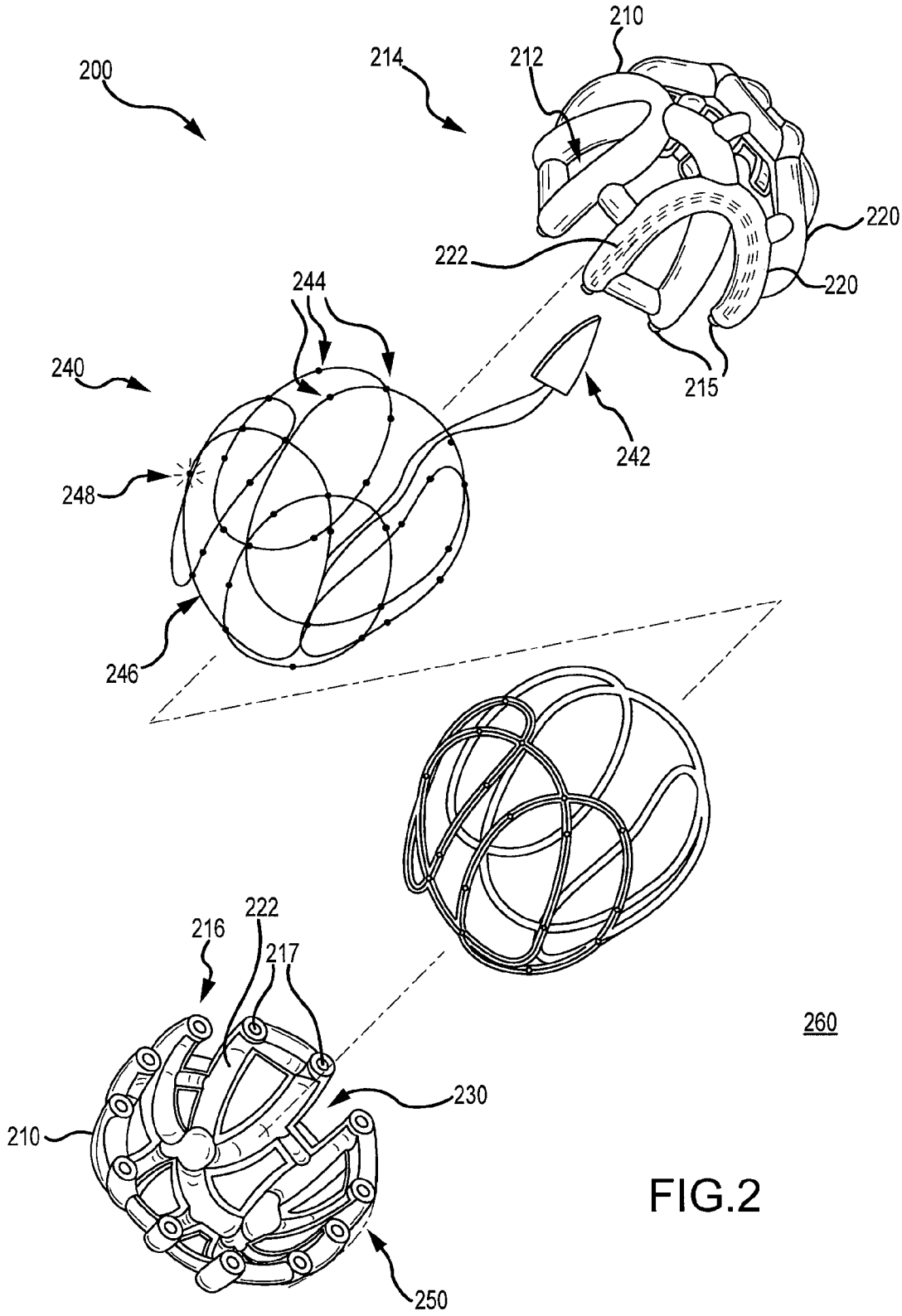
FIG. 2 illustrates an exploded perspective view of a toy according to embodiments of the present invention.

FIG. 2 illustrates an exploded perspective view of a toy according to embodiments of the present invention. Toy 200 includes a skeletal structure 210 having a plurality of segments 220. Skeletal structure 210 defines an open interior cavity 230. In some embodiments, open interior cavity 230 is in fluid communication with an ambient space 260 disposed at the outside of the toy. Optionally, open interior cavity 230 may be in fluid communication with ambient space 260 via a plurality of apertures 212 defined by skeletal structure 210. Segments 220 can have supports 222 such as channels or lumens. As shown here, toy 200 also includes a light assembly 240 having a power source 242 and a plurality of light emitting diodes (LEDs) 244. Light assembly 240 also includes a wire 246 that conducts electricity between power source 242 and LEDs 244. Light assembly 240 can be configured to direct light 248 into a plurality of supports 222.

As shown here, skeletal structure 210 can be constructed from a first portion 214 and a second portion 216. These portions may be coupled together in any of a variety of ways. For example, first portion 214 can include a plurality of posts 215, and second portion 216 can include a plurality of receptacles 217 that are adapted to receive posts 215. In the embodiment depicted here, first portion 214 and second portion 216 represent two hemispherical components, which form skeletal structure 210 when coupled together.

Figure 3:
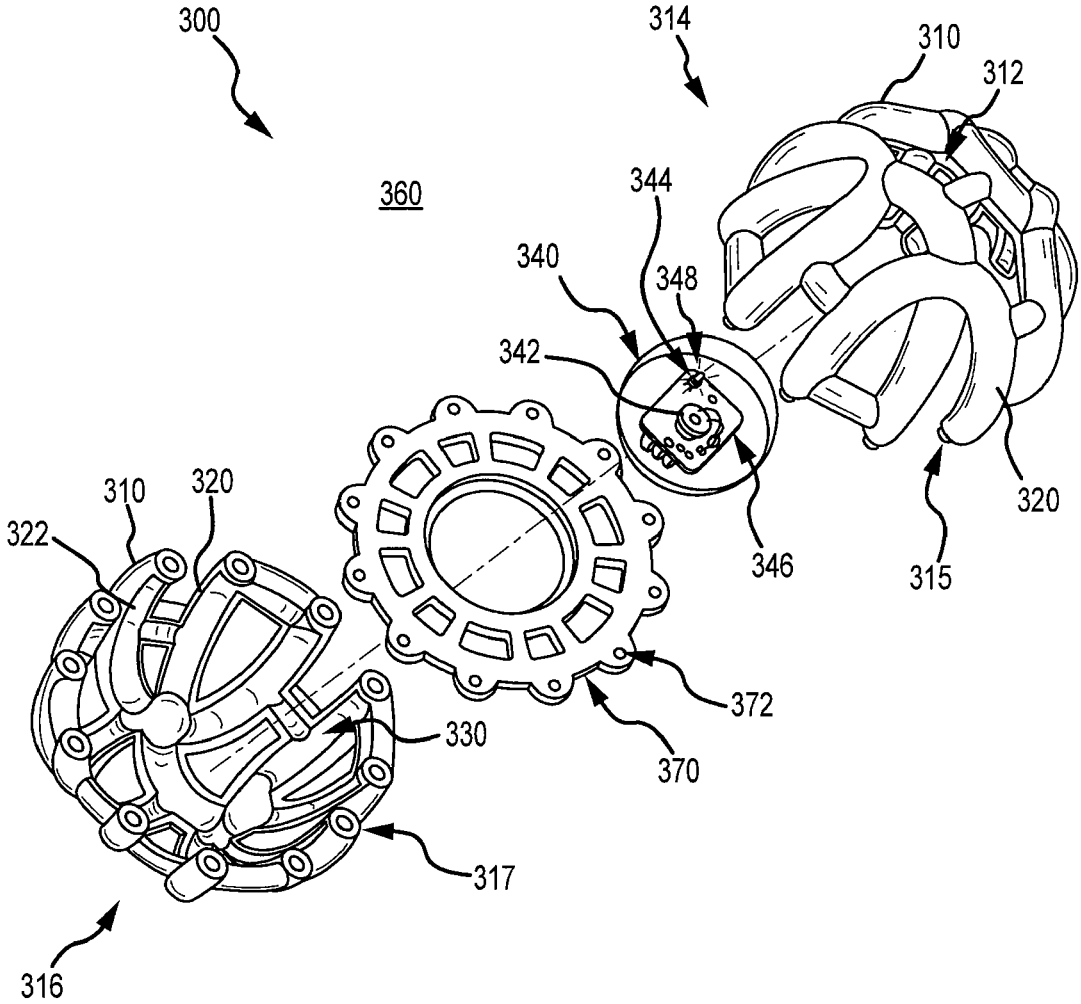
FIG. 3 illustrates an exploded perspective view of a toy according to embodiments of the present invention.

FIG. 3 illustrates an exploded perspective view of a toy according to embodiments of the present invention. Toy 300 includes a skeletal structure 310 having a plurality of segments 320. Skeletal structure 310 defines an open interior cavity 330. In some embodiments, open interior cavity 330 is in fluid communication with an ambient space 360 disposed outside of the toy. Optionally, open interior cavity 330 may be in fluid communication with ambient space 360 via a plurality of apertures 312 defined by skeletal structure 310. Segments 320 can have supports 322 such as channels or lumens. In some cases, one or more segments may not include a support. Toy 300 also includes a light assembly 340. Optionally, light assembly may include a power source 342. Light assembly 340 includes one or more light emitting elements 344. In some cases, light emitting element 344 may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 340 also includes one or more wires 346 that conduct electricity between power source 342 and light emitting element 344.

As shown here, skeletal structure 310 can be constructed from a first portion 314 and a second portion 316. These portions may be coupled together in any of a variety of ways. For example, first portion 314 can include a plurality of posts 315, and second portion 316 can include a plurality of receptacles 317 that are adapted to receive posts 315. In some embodiments, first portion 314 and second portion 316 represent two hemispherical components, which form skeletal structure 310 when coupled together. Toy 300 also includes a platform 370 configured to support or hold light assembly 340. Platform 370 can be coupled with skeletal structure 310 as desired. For example, platform 370 can include a plurality of apertures 372 which are adapted to receive posts 315 therethrough. Light assembly 340 can be configured to direct light 348 into a plurality of supports 322. As noted elsewhere herein, supports 322 can include channels or lumens.

Figure 4:
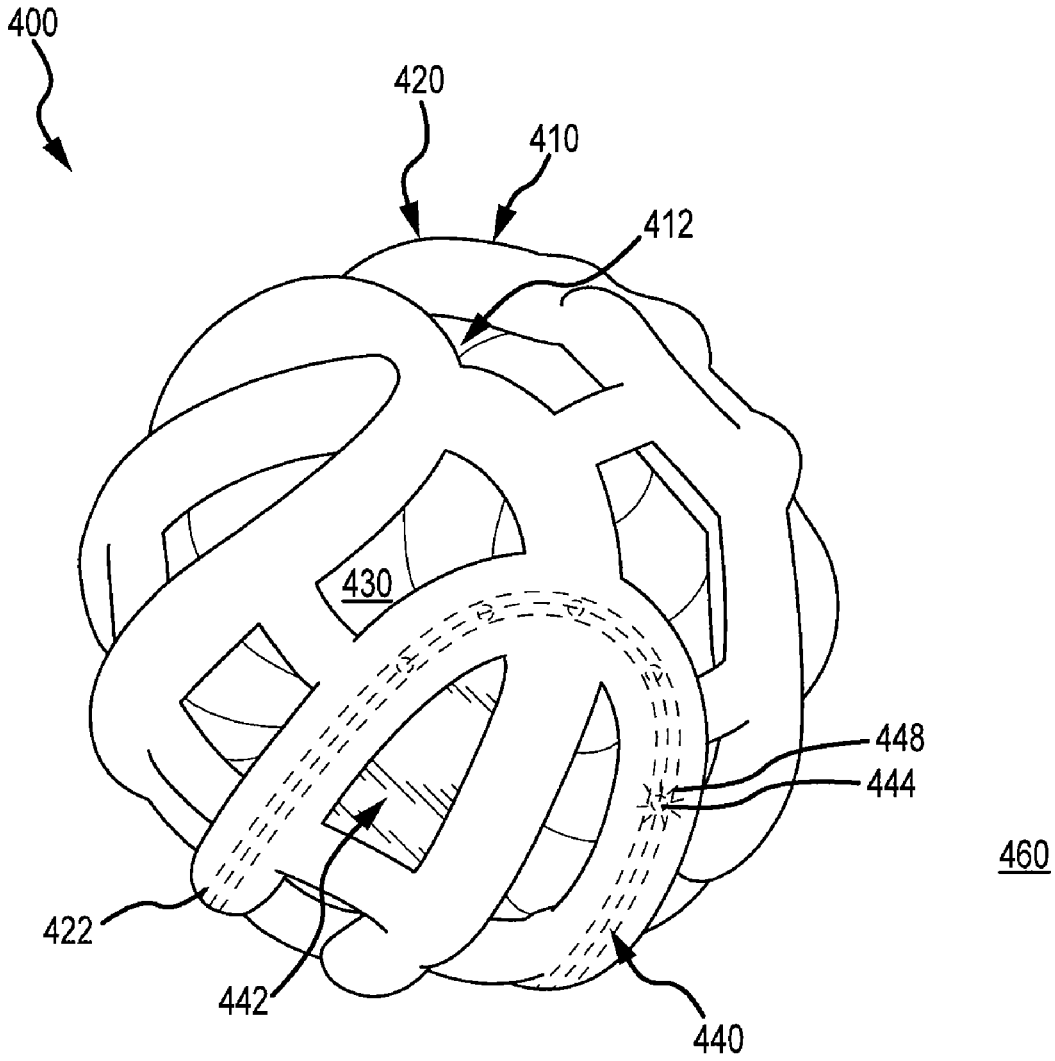
FIG. 4 illustrates a perspective view of a toy according to embodiments of the present invention.

FIG. 4 illustrates a perspective view of a toy according to embodiments of the present invention. Toy 400 includes a skeletal structure 410 having a single segment 420. In this sense, skeletal structure 410 may present a unitary or monolithic structure. Skeletal structure 410 defines an open interior cavity 430. In some embodiments, open interior cavity 430 is in fluid communication with an ambient space 460 disposed outside of the toy. Optionally, open interior cavity 430 may be in fluid communication with ambient space 460 via one or more apertures 412 which are defined by skeletal structure 410. Segment 420 can have one or more supports 422 such as channels or lumens. As shown here, toy 400 also includes a light assembly 440. Optionally, light assembly may include a power source 442. Light assembly 440 includes one or more light emitting elements 444. Light assembly 440 can be configured to direct light 448 into one or more supports 422.

Figure 5:
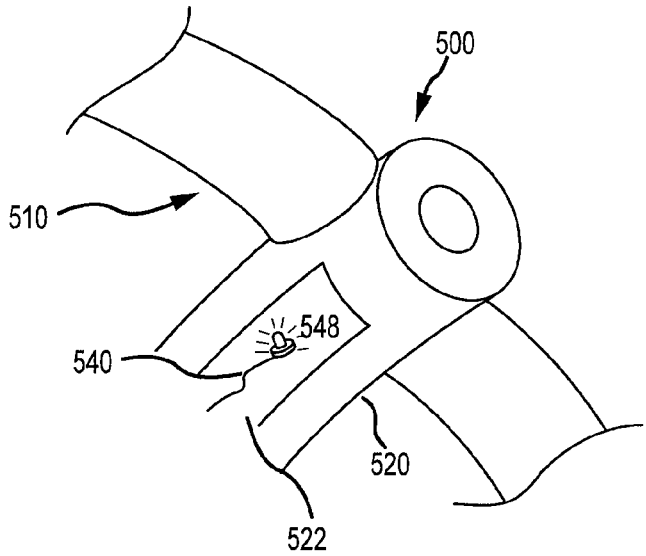
FIGS. 5 to 5E show aspects of a toy according to embodiments of the present invention.
Figure 5A:
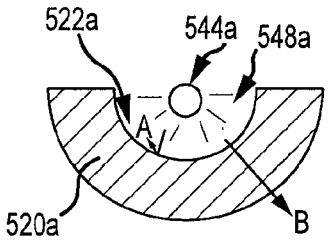
Figure 5B:
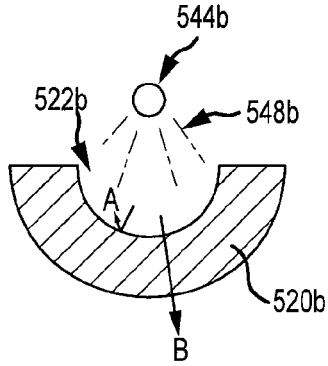
Figure 5C:
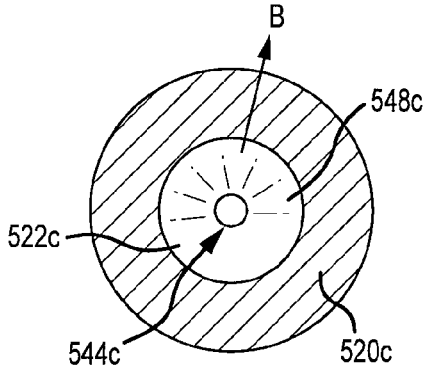
Figure 5D:
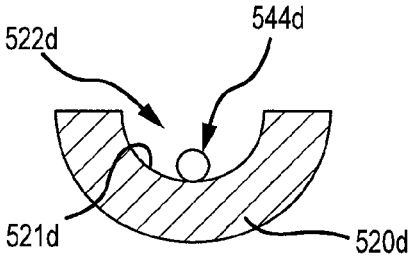
Figure 5E:
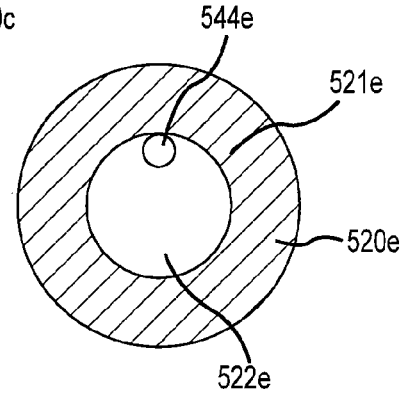

FIG. 5 shows a portion of a toy according to embodiments of the present invention. Toy 500 includes a skeletal structure 510 having a segment 520. As shown here, segment 520 includes a channel 522 that can receive light 548 emitted from a light assembly 540. FIG. 5A shows a cross-section of a skeletal structure segment 520*a* of a toy, according to embodiments of the present invention. The toy includes a light emitting element 544*a* disposed at least partially within a channel 522*a* of segment 520*a*. Light emitting element 544*a* is configured to illuminate channel 522*a* with light 548*a*. In some cases, light 548*a* is reflected from the surface of segment 520*a*, as indicated by arrow A. In some cases, light 548*a* is transmitted through segment 520*a*. For example, light 548*a* can be transmitted through segment 520*a*, as indicated by arrow B. Light reflecting and transmitting properties of segment 520*a* may depend on the material used to construct the segment. For example, segment 520*a* or a portion thereof may include a reflective surface material, such as a mirror, which reflects light. Similarly, segment 520*a* or a portion thereof may include a transparent material such as glass, or a translucent material such as frosted glass, which allows light to pass therethrough. Segment 520*a* can be configured to provide light reflection or transmission, in either a diffuse or specular fashion. In some cases, segment 520*a* or a portion thereof may include an opaque material, through which light cannot pass. FIG. 5B shows a cross-section of a skeletal structure segment 520*b* of a toy, according to embodiments of the present invention. The toy includes a light emitting element 544*b* disposed outside of channel 522*b*. Light emitting element 544*b* is configured to illuminate channel 522*b* with light 548*b*. In some cases, light 548*b* is reflected from the surface of segment 520*b*, as indicated by arrow A. In some cases, light 548*b* is transmitted through segment 520*b*. For example, light 548*b* can be transmitted through segment 520*b*, as indicated by arrow B. Light reflecting and transmitting properties of segment 520*b* may depend on the material used to construct the segment. For example, segment 520*b* or a portion thereof may include a reflective surface material, such as a mirror, which reflects light. Similarly, segment 520*b* or a portion thereof may include a transparent material such as glass, or a translucent material such as frosted glass, which allows light to pass therethrough. Segment 520*b* can be configured to provide light reflection or transmission, in either a diffuse or specular fashion. In some cases, segment 520*b* or a portion thereof may include an opaque material, through which light cannot pass. FIG. 5C shows a cross-section of a skeletal structure segment 520*c* of a toy, according to embodiments of the present invention. Segment 520*c* presents a tubular or closed configuration. The toy includes a light emitting element 544*c* disposed within a lumen 522*c*. Light emitting element 544*c* is configured to illuminate channel 522*c* with light 548*c*. Light 548*c* is transmitted through segment 520*c*. For example, light 548*c* can be transmitted through segment 520*c*, as indicated by arrow B. Light transmitting properties of segment 520*c* may depend on the material used to construct the segment. For example, segment 520*c* or a portion thereof may include a transparent material such as glass, or a translucent material such as frosted glass, which allows light to pass therethrough. Segment 520*c* can be configured to provide light transmission, in either a diffuse or specular fashion. In some cases, segment 520*c* or a portion thereof may include an opaque material, through which light cannot pass. As shown in FIG. 5D, in some embodiments a light emitting element 544*d* or another portion of a light assembly can be directly coupled with or adjacent to segment 520*d*. For example, light emitting element 544*d* can be attached with a segment surface 521*d* of segment 520*d* that is disposed within channel 522*d*. FIG. 5E shows a similar construction, where light emitting element 544*e* is attached with or adjacent to a segment surface 521*e* of segment 520*e*, where segment surface 521*e* is disposed within lumen 522*e*.

Figure 6:
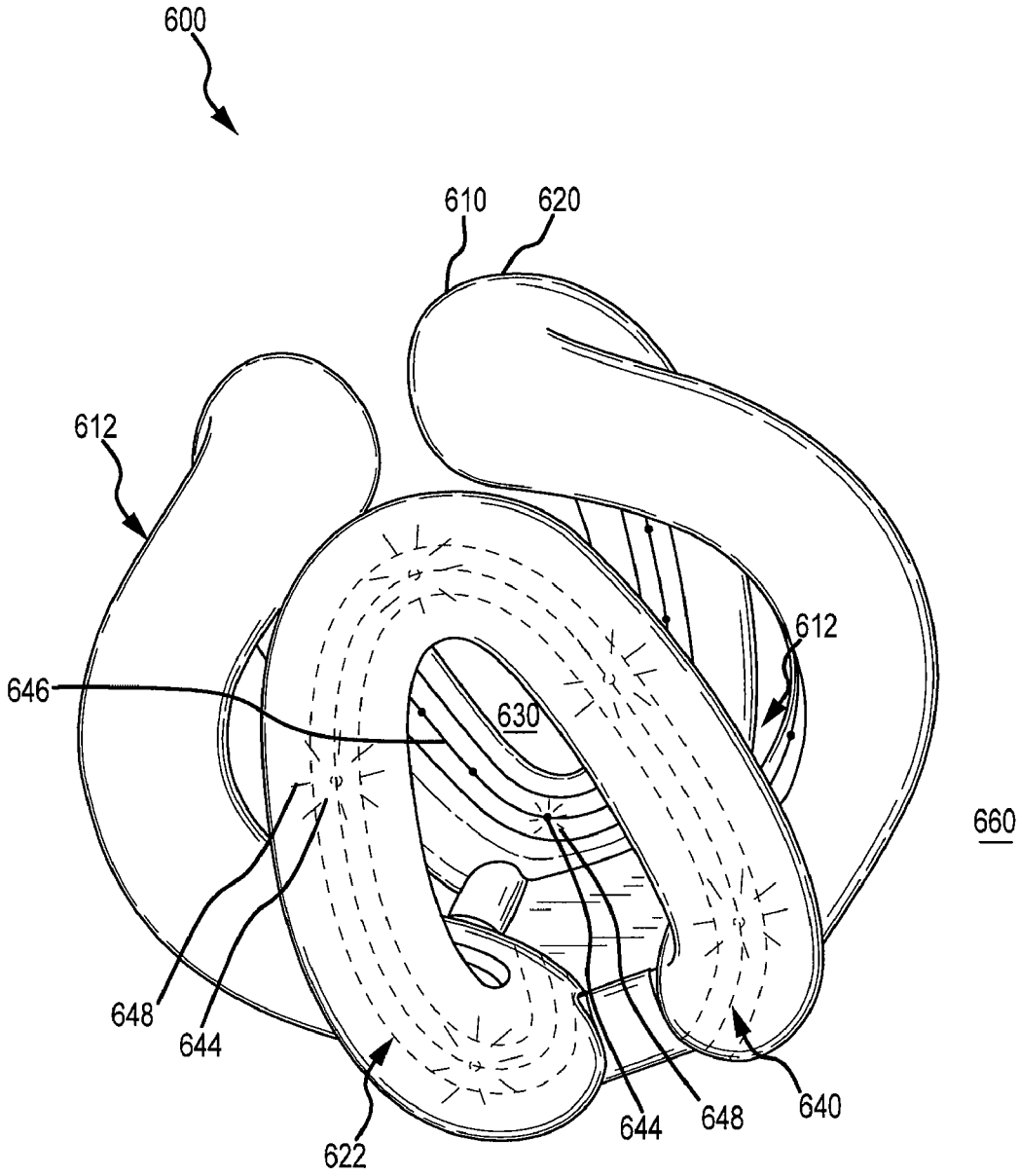
FIG. 6 illustrates a perspective view of a toy according to embodiments of the present invention.

In addition to the shapes depicted in FIGS. 1-4, embodiments of the present invention provide skeletal structures having generally spherical shapes in other desired or useful configurations. FIG. 6 illustrates a perspective view of a toy according to embodiments of the present invention. The toy includes looped or bent segments, such as those described in U.S. patent application Ser. No. 11/558,350 filed Nov. 9, 2006, the contents of which are incorporated herein by reference. Toy 600 includes a skeletal structure 610 having one or more segments 620. Skeletal structure 610 defines an open interior cavity 630. In some embodiments, open interior cavity 630 is in fluid communication with an ambient space 660 disposed outside of the toy. Optionally, open interior cavity 630 may be in fluid communication with ambient space 660 via one or more apertures 612 which are defined by skeletal structure 610. Segment 620 can have one or more supports 622 such as channels or lumens. As shown here, toy 600 also includes a light assembly 640. Optionally, light assembly may include a power source 642. Light assembly 640 includes one or more light emitting elements 644. Light assembly 640 can be configured to direct light 648 into one or more supports 622. Wire 646 can conduct electricity from power source 642 to light emitting elements 644.

Figure 7:
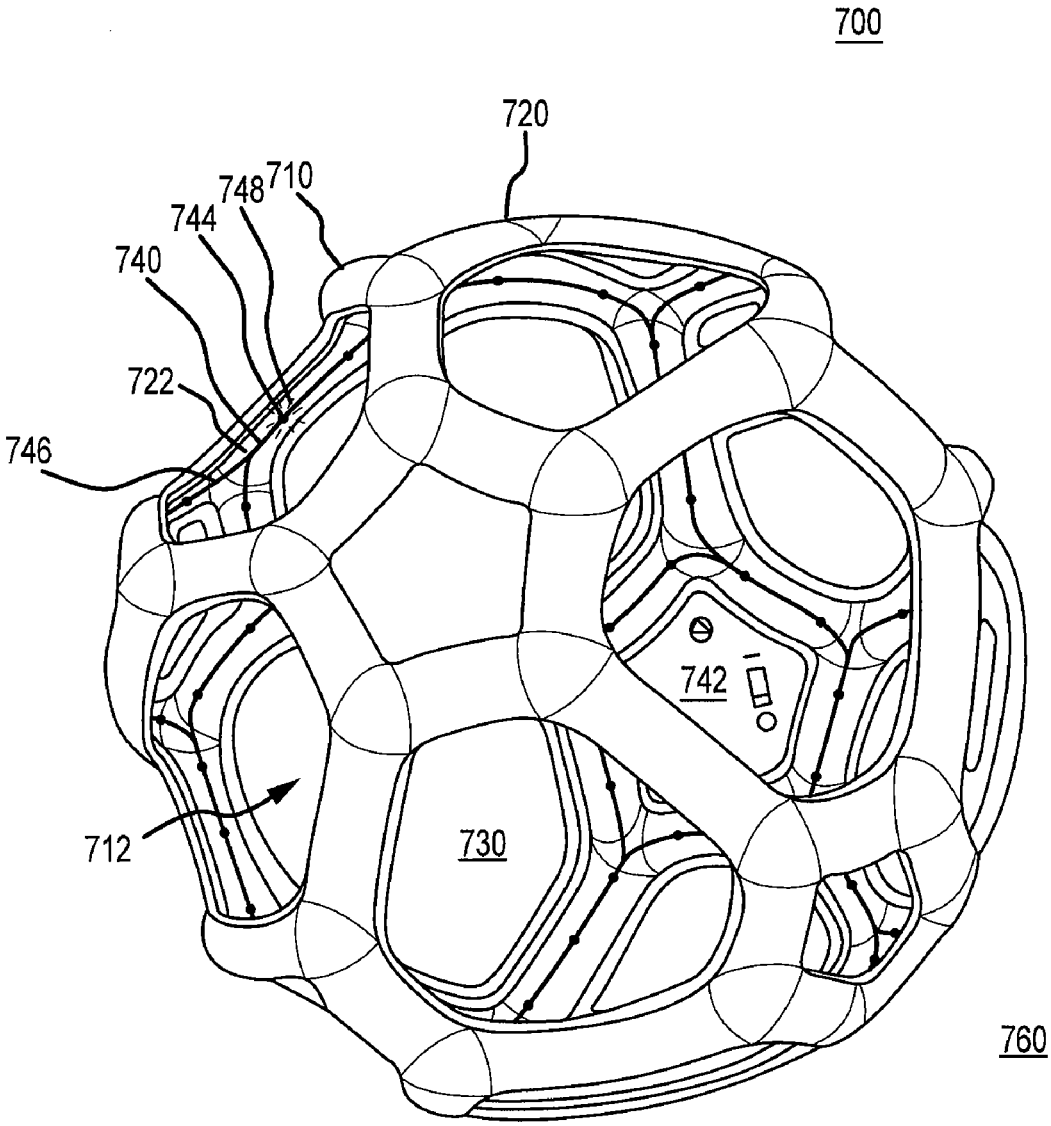
FIG. 7 illustrates a perspective view of a toy according to embodiments of the present invention.

FIG. 7 illustrates a perspective view of a toy according to embodiments of the present invention. Toy 700 includes a skeletal structure 710 having one or more segments 720. Toy 700 can provide a soccer ball type of shape or construction. Skeletal structure 710 defines an open interior cavity 730. In some embodiments, open interior cavity 730 is in fluid communication with an ambient space 760 disposed outside of the toy. Optionally, open interior cavity 730 may be in fluid communication with ambient space 760 via one or more apertures 712 which are defined by skeletal structure 710. Segment 720 can have one or more supports 722 such as channels or lumens. As shown here, toy 700 also includes a light assembly 740. Optionally, light assembly may include a power source 742. Light assembly 740 includes one or more light emitting elements 744. Light assembly 740 can be configured to direct light 748 into one or more supports 722. Wire 746 can conduct electricity from power source 742 to light emitting elements 744.

Figure 8:
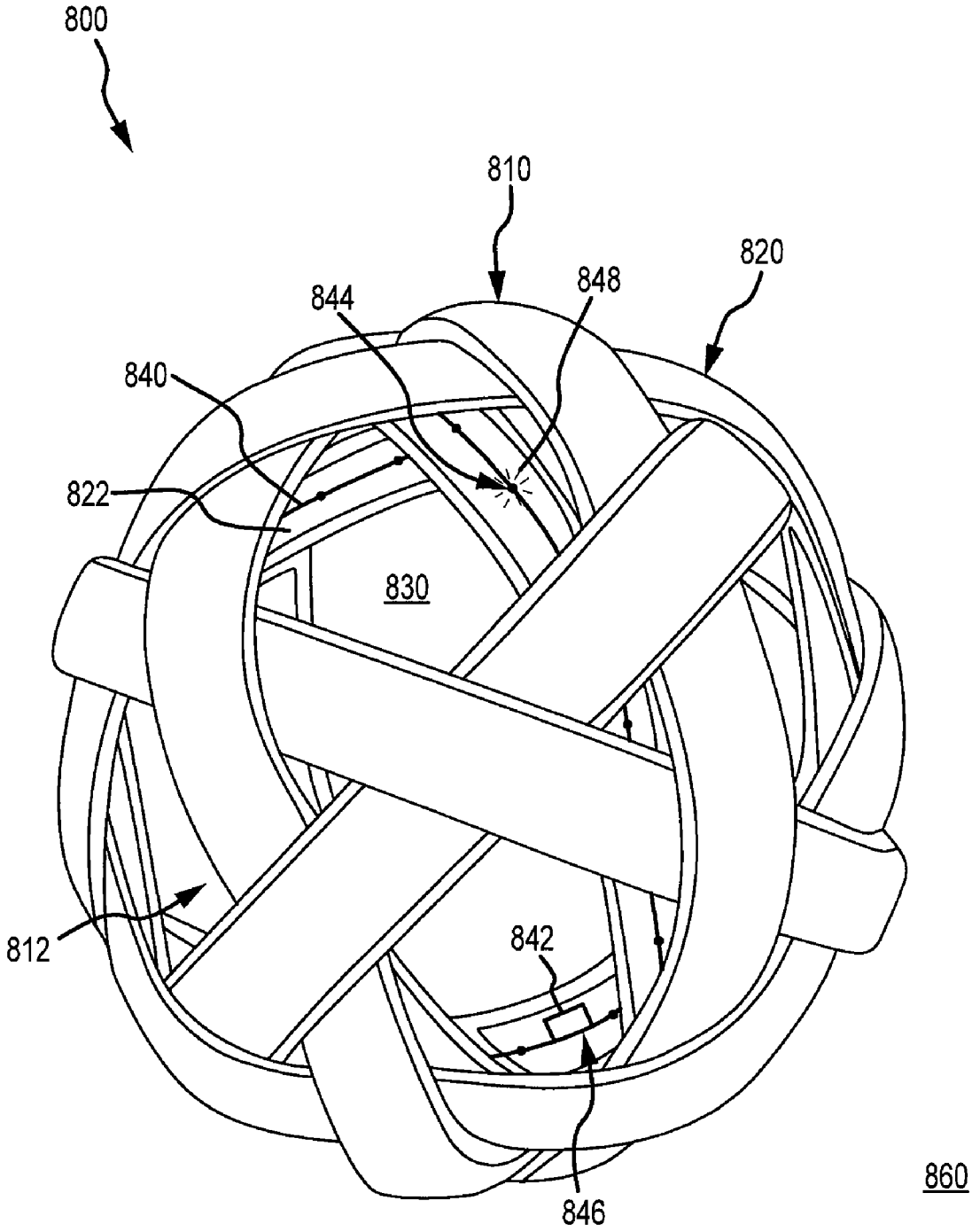
FIG. 8 illustrates a perspective view of a toy according to embodiments of the present invention.

FIG. 8 illustrates a perspective view of a toy according to embodiments of the present invention. Toy 800 can provide a continuous weave type of shape or construction. Toy 800 includes a skeletal structure 810 having one or more segments 820. Skeletal structure 810 defines an open interior cavity 830. In some embodiments, open interior cavity 830 is in fluid communication with an ambient space 860 disposed outside of the toy. Optionally, open interior cavity 830 may be in fluid communication with ambient space 860 via one or more apertures 812 which are defined by skeletal structure 810. Segment 820 can have one or more supports 822 such as channels or lumens. As shown here, toy 800 also includes a light assembly 840. Optionally, light assembly may include a power source 842. Light assembly 840 includes one or more light emitting elements 844. Light assembly 840 can be configured to direct light 848 into one or more supports 822. Wire 846 can conduct electricity from power source 842 to light emitting elements 844.

Figure 9:
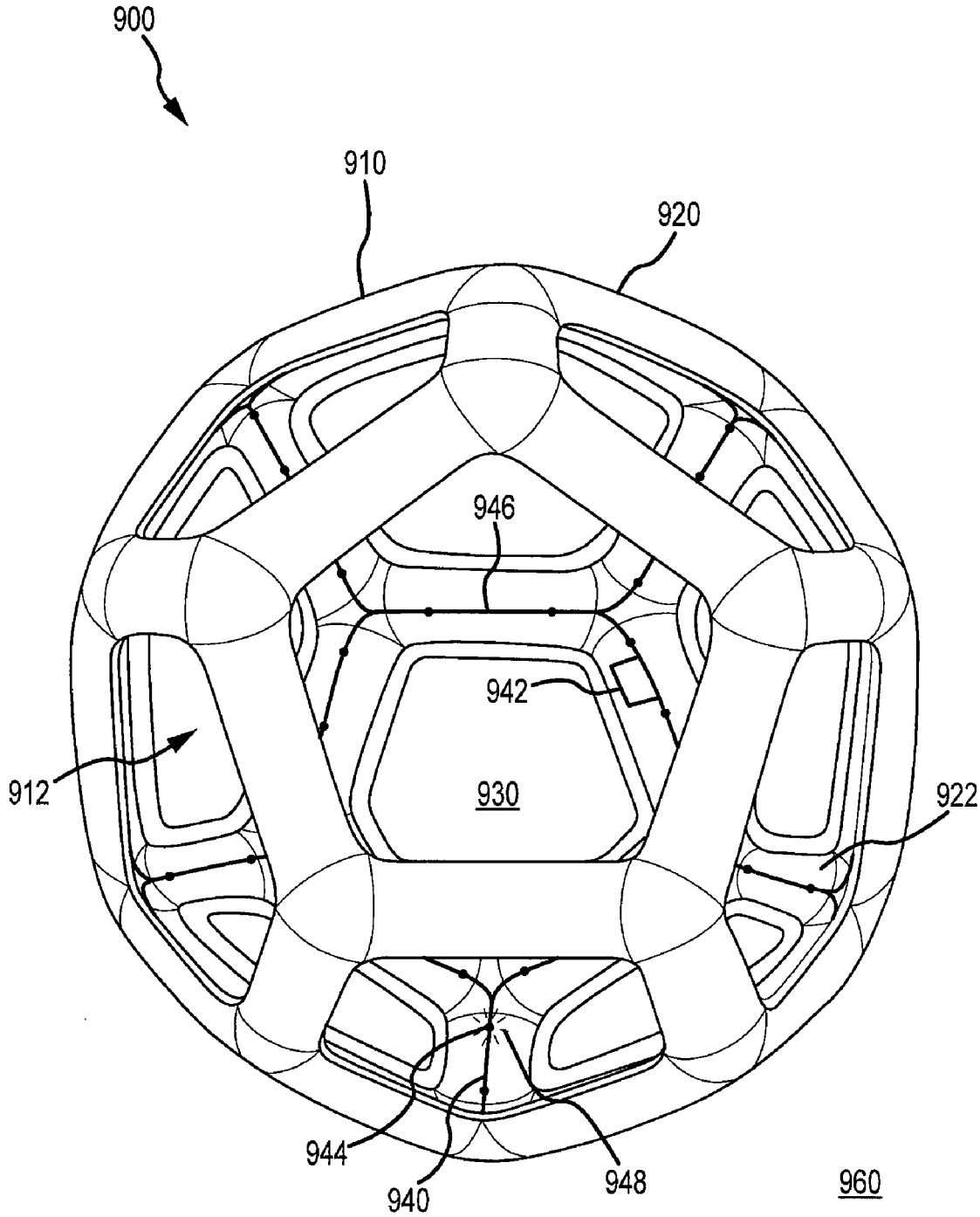
FIG. 9 illustrates a perspective view of a toy according to embodiments of the present invention.

FIG. 9 illustrates a perspective view of a toy according to embodiments of the present invention. Toy 900 can provide a pentagon type of shape or construction. Toy 900 includes a skeletal structure 910 having one or more segments 920. Skeletal structure 910 defines an open interior cavity 930. In some embodiments, open interior cavity 930 is in fluid communication with an ambient space 960 disposed outside of the toy. Optionally, open interior cavity 930 may be in fluid communication with ambient space 960 via one or more apertures 912 which are defined by skeletal structure 910. Segment 920 can have one or more supports 922 such as channels or lumens. As shown here, toy 900 also includes a light assembly 940. Optionally, light assembly may include a power source 942. Light assembly 940 includes one or more light emitting elements 944. Light assembly 940 can be configured to direct light 948 into one or more supports 922. Wire 946 can conduct electricity from power source 942 to light emitting elements 944.

Figure 10:
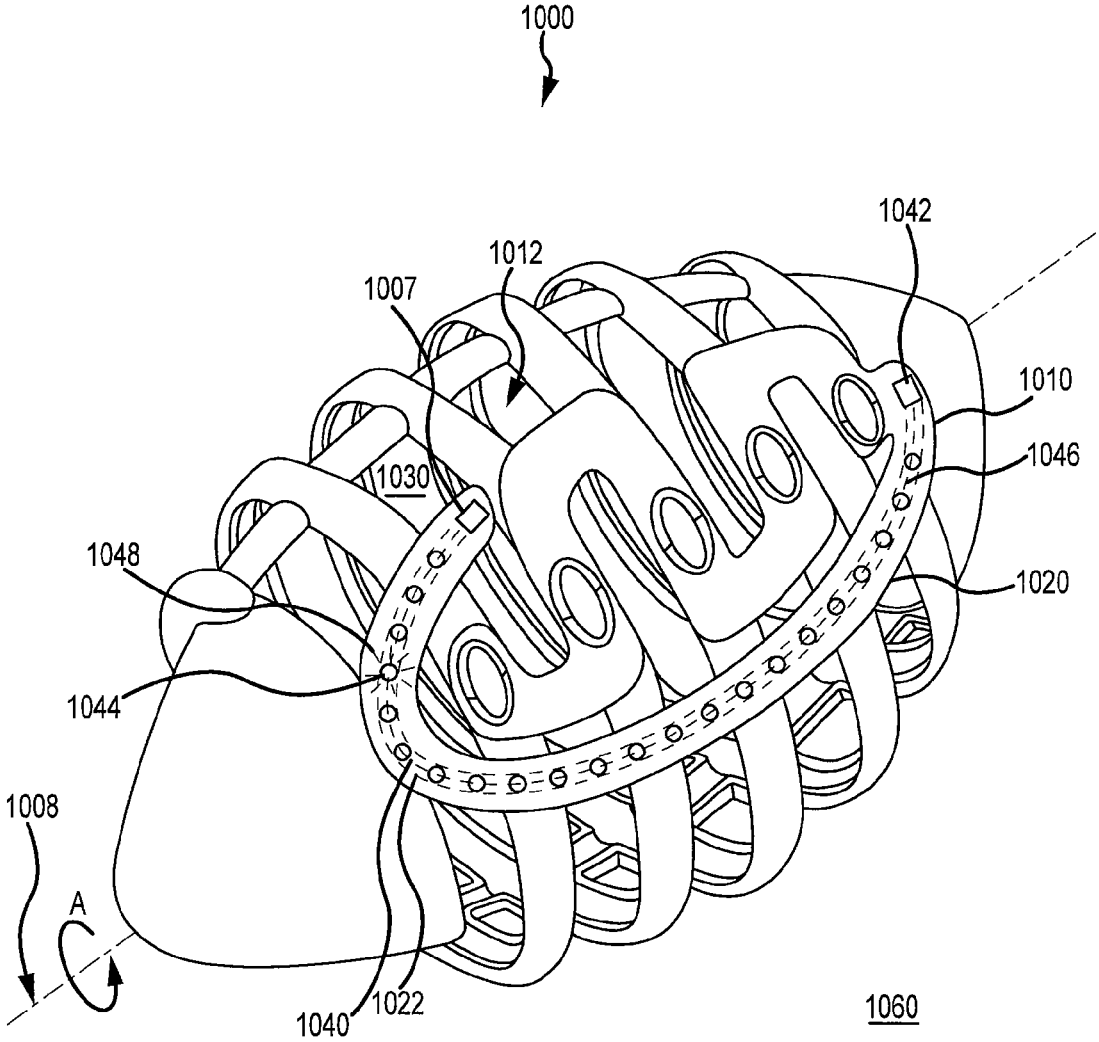
FIG. 10 illustrates a perspective view of a toy according to embodiments of the present invention

FIG. 10 illustrates a perspective view of a toy according to embodiments of the present invention. Toy 1000 can provide a football type of shape or construction, configured to present a lighted message. Toy 1000 includes a skeletal structure 1010 having one or more segments 1020. Skeletal structure 1010 defines an open interior cavity 1030. In some embodiments, open interior cavity 1030 is in fluid communication with an ambient space 1060 disposed outside of the toy. Optionally, open interior cavity 1030 may be in fluid communication with ambient space 1060 via one or more apertures 1012 which are defined by skeletal structure 1010. Segment 1020 can have one or more supports 1022 such as channels or lumens. As shown here, toy 1000 also includes a light assembly 1040. Optionally, light assembly may include a power source 1042. Light assembly 1040 includes one or more light emitting elements 1044. Light assembly 1040 can be configured to direct light 1048 into one or more supports 1022. Wire 1046 can conduct electricity from power source 1042 to light emitting elements 1044. Toy 1000 may also include a processor 1007 coupled with or integrated into lighting assembly 1040. Processor 1007 can be configured to activate and deactivate light emitting elements 1044 as desired. For example, processor 1007 can be configured to activate and deactivate light emitting elements 1004 in a sequence so that toy 1000 presents a lighted text message or other pattern when toy 1000 spins or rotates about an axis 1008 as indicated by arrow A, such as when toy 1000 it thrown by a toy user.

Figure 11:
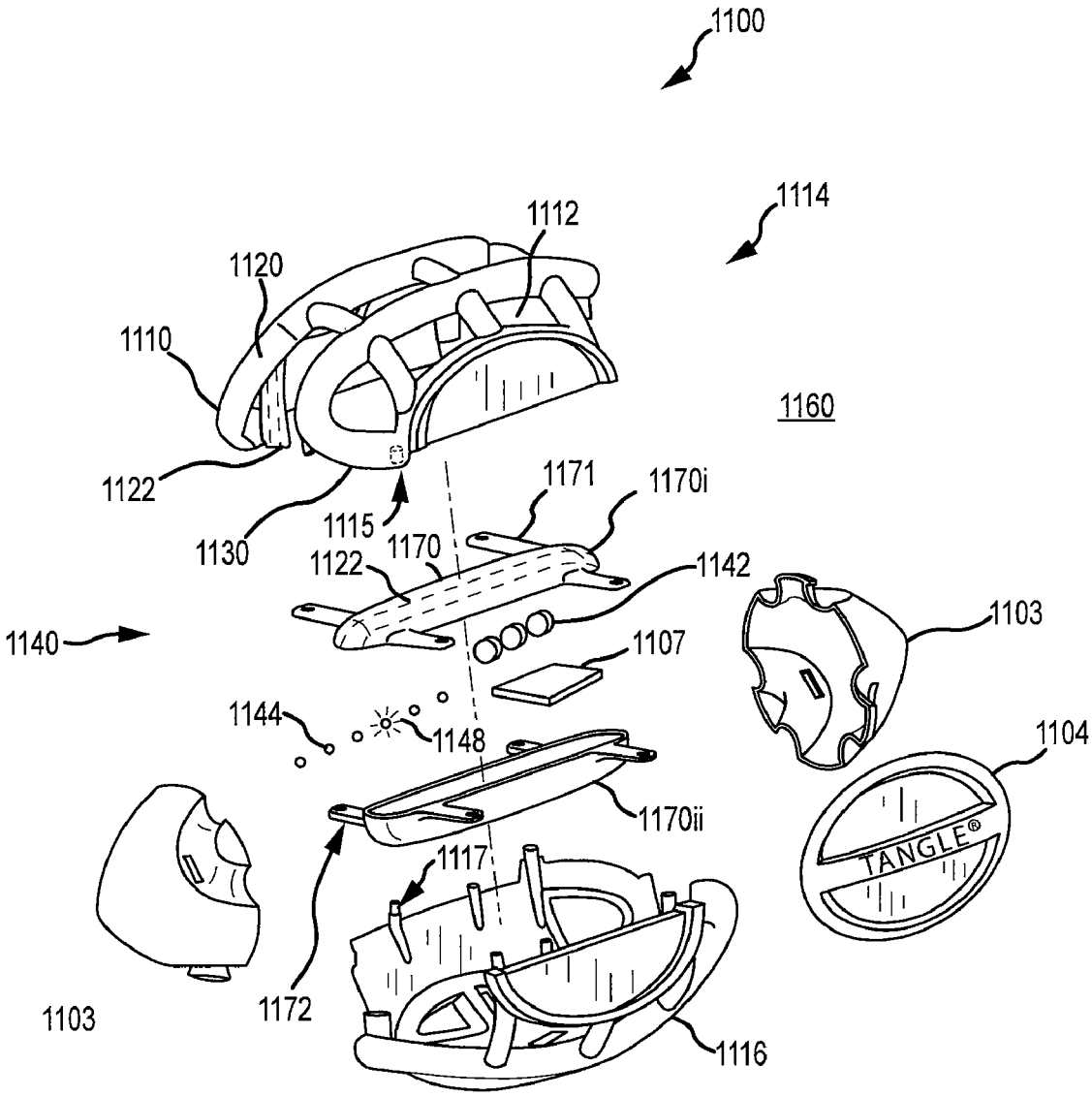
FIGS. 11 to 11B show aspects of a toy according to embodiments of the present invention.

FIG. 11 illustrates an exploded perspective view of a toy according to embodiments of the present invention. Toy 1100 includes a skeletal structure 1110 having a plurality of segments 1120. Skeletal structure 1110 defines an open interior cavity 1130. In some embodiments, open interior cavity 1130 is in fluid communication with an ambient space 1160 disposed outside of the toy. Optionally, open interior cavity 1130 may be in fluid communication with ambient space 1160 via a plurality of apertures 1112 defined by skeletal structure 1110. Segments 1120 can have supports 1122 such as channels or lumens. In some cases, one or more segments may not include a support. Toy 1100 also includes a light assembly 1140. Optionally, light assembly may include a power source 1142, such as one or more button cell batteries, and a PC board or processor 1107 which contains a tangible medium embodying machine-readable code for controlling activation of the light emitting elements. Light assembly 1140 includes one or more light emitting elements 1144 that emit light 1148. In some cases, light emitting element 1144 may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1140 may also includes one or more wires that conduct electricity between power source 1142 and light emitting element 1144.

Figure 11A:
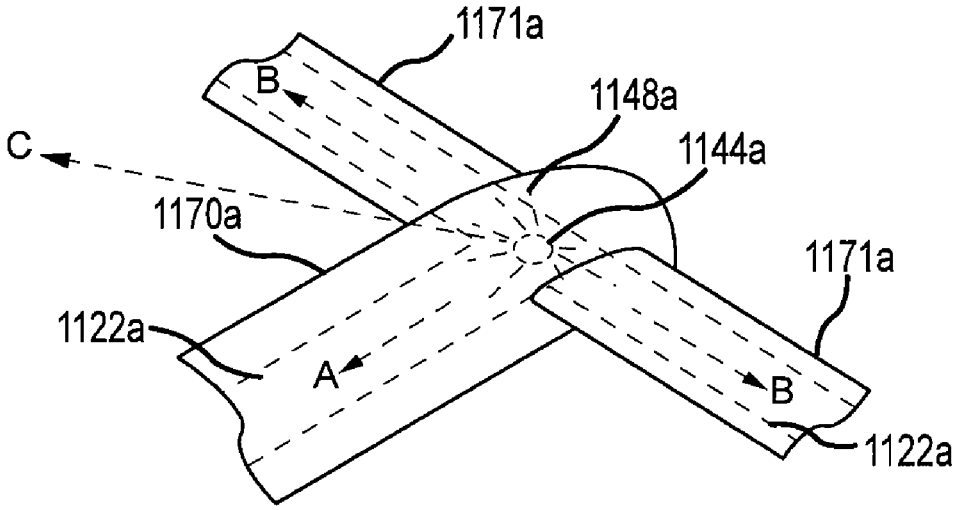
Figure 11B:
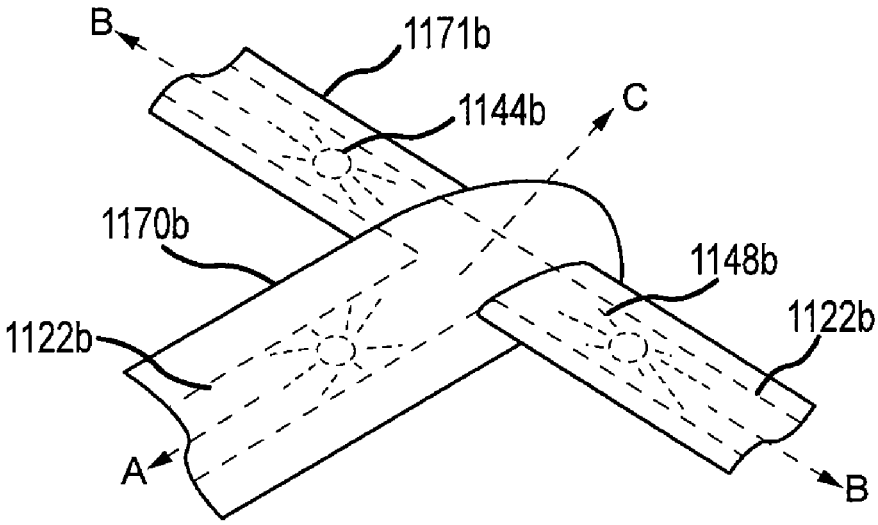

As shown here, skeletal structure 1110 can be constructed from a first portion 1114 and a second portion 1116. These portions may be coupled together in any of a variety of ways. For example, first portion 1114 can include a plurality of receptacles 1115, and second portion 1116 can include a plurality of posts 1117 that are adapted to insert into receptacles 1115. In some embodiments, first portion 1114 and second portion 1116 represent two components, which form a skeletal structure 1110 having a prolate spheroid shape, such as an American football shape, when coupled together. As shown here, toy 1100 can also include end caps 1103 and a logo plate 1104 which can be coupled with skeletal structure 1110. Toy 1100 also includes a platform 1170 configured to support or hold light assembly 1140. Platform 1170 can include supports 1122 such as channels or lumens. Platform 1170 can be coupled with skeletal structure 1110 as desired. For example, platform 1170 can include one or more struts 1171 that attach with skeletal structure 1110. Optionally, struts 1171 may include one or more apertures 1172 which are adapted to receive posts 1117 therethrough. In some cases, a platform can be constructed of one or more pieces. For example, platform 1170 is depicted here as a composite structure that includes platform top bracket 1170*i* and platform bottom bracket 1170*ii*. As shown in FIG. 11A, a light emitting element 1144*a* can be disposed within, or positioned to direct light 1148*a* into, a support 1122*a* such as a channel or lumen of a platform 1170*a*. Light emitting element 1144*a* can also transmit light 1148*a* into or toward a support 1122*a* such as a channel or lumen of a strut 1171*a*. For example, support 1122*a* of platform 1170*a* can transmit light 1148*a*, as indicated by arrow A, and supports 1122*a* of struts 1171*a* can transmit light 1148*a*, as indicated by arrows B. Light emitting element 1144*a* can also direct or project light as indicated by arrow C beyond a support 1122*a*, platform 1170*a*, or struts 1171*a*, toward or onto a skeletal structure, or toward or onto or through a logo panel or plate associated with the structure, or through an aperture in a skeletal structure toward an ambient space or environment. In some cases, a light emitting element 1144*b* can be disposed within, and configured to direct light 1148*b* into, a support 1122*b* such as a channel or lumen of a strut 1171*b*, as shown in FIG. 11B. Relatedly, light emitting element 1144*b* can be disposed within support 1122*b* of strut 1171*b*, and configured to direct or transmit light toward or within support 1122*b* of platform 1170*b*. For example, support 1122*b* of platform 1170*b* can transmit light 1148*b*, as indicated by arrow A, and supports 1122*b* of struts 1171*b* can transmit light 1148*b*, as indicated by arrows B. Light emitting element 1144*b* can also direct or project light as indicated by arrow C beyond a support 1122*b*, platform 1170*b*, or struts 1171*b*, toward or onto a skeletal structure, or through an aperture in a skeletal structure toward an ambient space or environment.

Figure 12:
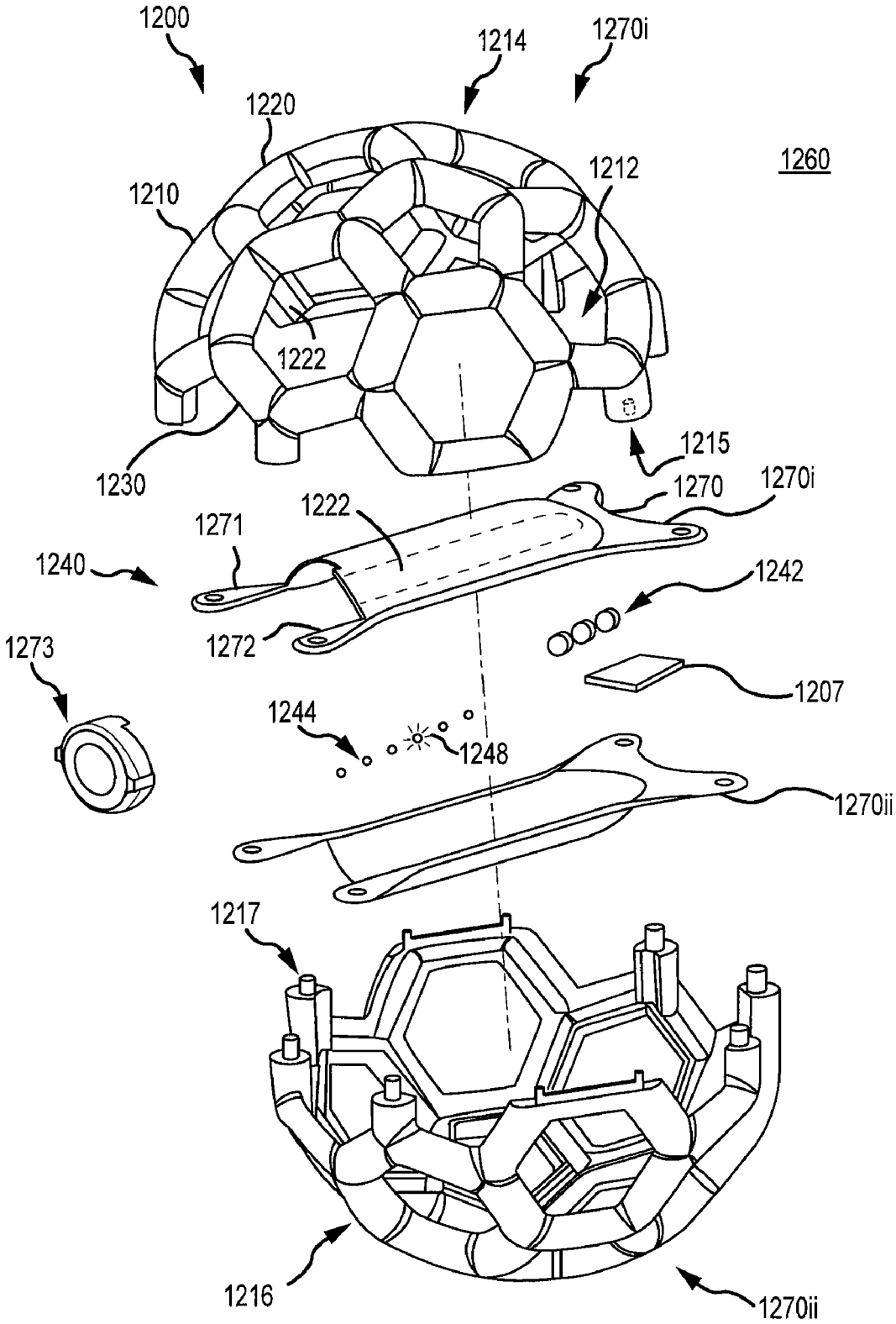
FIGS. 12 to 12B show aspects of a toy according to embodiments of the present invention.

FIG. 12 illustrates an exploded perspective view of a toy according to embodiments of the present invention. Toy 1200 includes a skeletal structure 1210 having a plurality of segments 1220. Skeletal structure 1210 defines an open interior cavity 1230. In some embodiments, open interior cavity 1230 is in fluid communication with an ambient space 1260 disposed outside of the toy. Optionally, open interior cavity 1230 may be in fluid communication with ambient space 1260 via a plurality of apertures 1212 defined by skeletal structure 1210. Segments 1220 can have supports 1222 such as channels or lumens. In some cases, one or more segments may not include a support. Toy 1200 also includes a light assembly 1240. Optionally, light assembly may include a power source 1242, such as one or more button cell batteries, and a PC board or processor 1207 which contains a tangible medium embodying machine-readable code for controlling activation of the light emitting elements. Light assembly 1240 includes one or more light emitting elements 1244 that emit light 1248. In some cases, light emitting element 1244 may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1240 may also includes one or more wires that conduct electricity between power source 1242 and light emitting element 1244.

Figure 12A:
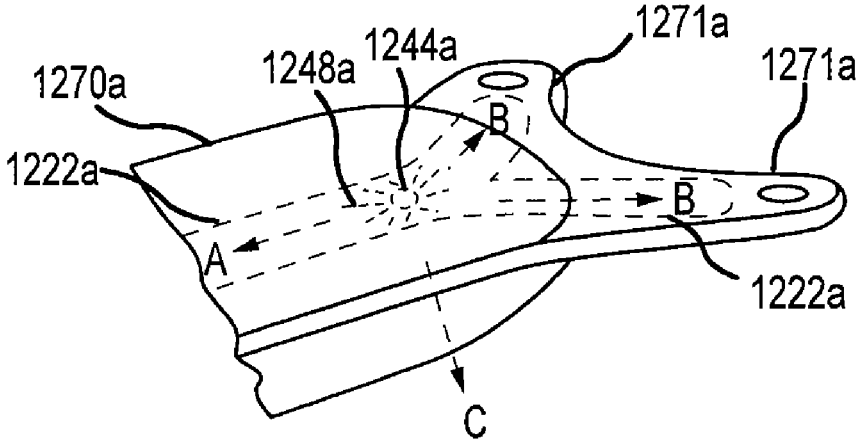
Figure 12B:
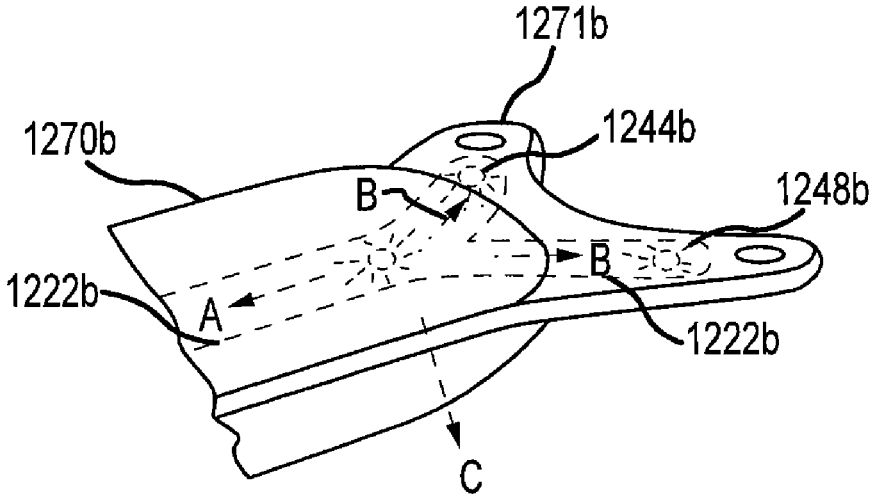

As shown here, skeletal structure 1210 can be constructed from a first portion 1214 and a second portion 1216. These portions may be coupled together in any of a variety of ways. For example, first portion 1214 can include a plurality of receptacles 1215, and second portion 1216 can include a plurality of posts 1217 that are adapted to insert into receptacles 1215. In some embodiments, first portion 1214 and second portion 1216 represent two generally hemigeodesic or semigeodesic components, which form a skeletal structure 1210 having a geodesic shape when coupled together. Toy 1200 also includes a platform 1270 configured to support or hold light assembly 1240. As shown here, platform 1270 can include a removable cap 1273, such as a snap lid. Platform 1270 can include supports 1222 such as channels or lumens. Platform 1270 can be coupled with skeletal structure 1210 as desired. For example, platform 1270 can include one or more struts 1271 that attach with skeletal structure 1210. Optionally, struts 1271 may include one or more apertures 1272 which are adapted to receive posts 1217 therethrough. In some cases, a platform can be constructed of one or more pieces. For example, platform 1270 is depicted here as a composite structure that includes platform top bracket 1270*i* and platform bottom bracket 1270*ii*. As shown in FIG. 12A, a light emitting element 1244*a* can be disposed within, or positioned to direct light 1248*a* into, a support 1222*a* such as a channel or lumen of a platform 1270*a*. Light emitting element 1244*a* can also transmit light 1248*a* into or toward a support 1222*a* such as a channel or lumen of a strut 1271*a*. For example, support 1222*a* of platform 1270*a* can transmit light 1248*a*, as indicated by arrow A, and supports 1222*a* of struts 1271*a* can transmit light 1248*a*, as indicated by arrows B. Light emitting element 1244*a* can also direct or project light as indicated by arrow C beyond a support 1222*a*, platform 1270*a*, or struts 1271*a*, toward or onto a skeletal structure, or through an aperture in a skeletal structure toward an ambient space or environment. In some cases, a light emitting element 1244*b* can be disposed within, and configured to direct light 1248*b* into, a support 1222*b* such as a channel or lumen of a strut 1271*b*, as shown in FIG. 12B. Relatedly, light emitting element 1244*b* can be disposed within support 1222*b* of strut 1271*b*, and configured to direct or transmit light toward or within support 1222*b* of platform 1270*b*. For example, support 1222*b* of platform 1270*b* can transmit light 1248*b*, as indicated by arrow A, and supports 1222*b* of struts 1271*b* can transmit light 1248*b*, as indicated by arrows B. Light emitting element 1244*b* can also direct or project light as indicated by arrow C beyond a support 1222*b*, platform 1270*b*, or struts 1271*b*, toward or onto a skeletal structure, or through an aperture in a skeletal structure toward an ambient space or environment.

Figure 13:
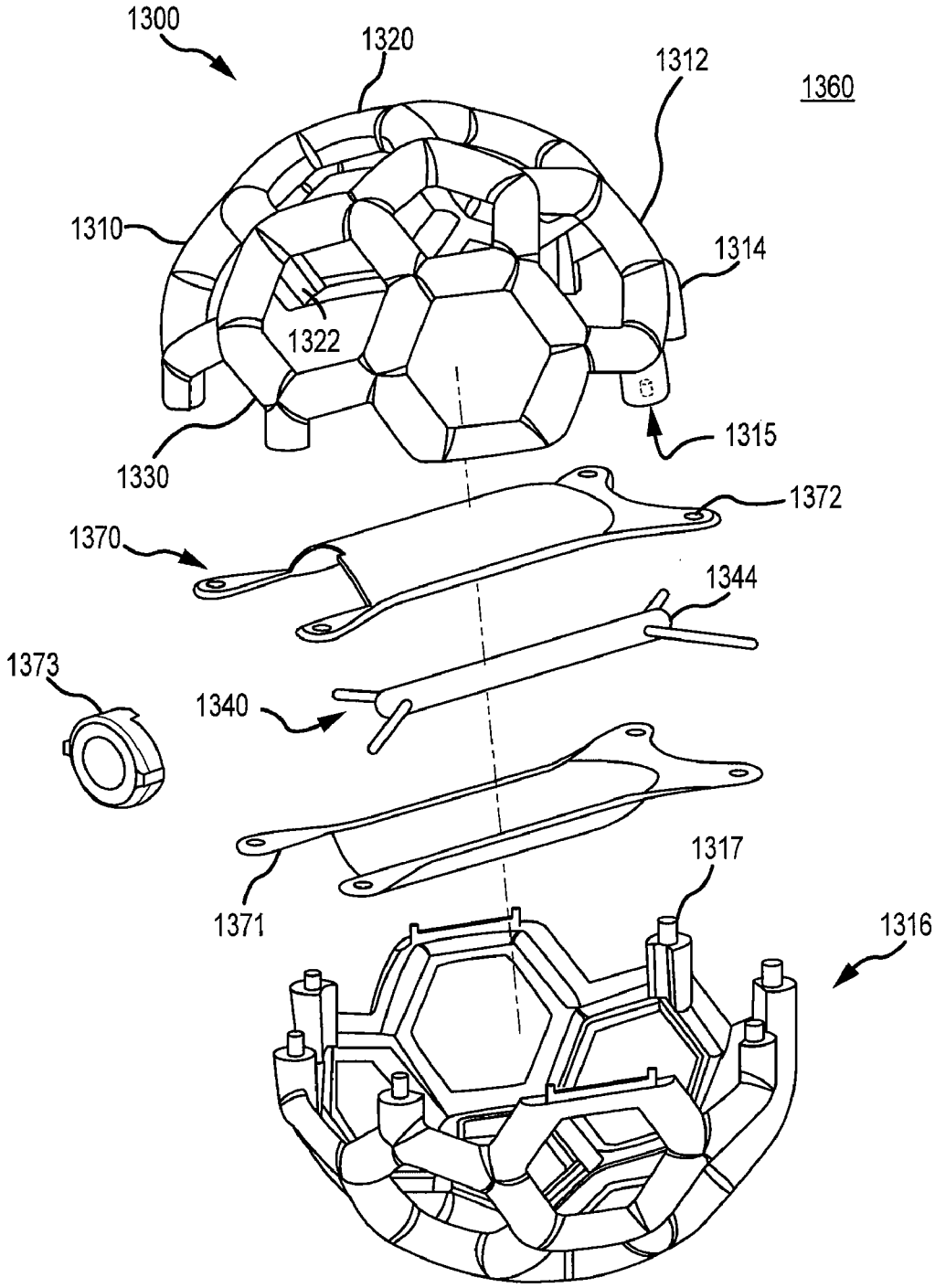
FIGS. 13 to 13B show aspects of a toy according to embodiments of the present invention.

FIG. 13 illustrates an exploded perspective view of a toy according to embodiments of the present invention. Toy 1300 includes a skeletal structure 1310 having a plurality of segments 1320. Skeletal structure 1310 defines an open interior cavity 1330. In some embodiments, open interior cavity 1330 is in fluid communication with an ambient space 1360 disposed outside of the toy. Optionally, open interior cavity 1330 may be in fluid communication with ambient space 1360 via a plurality of apertures 1312 defined by skeletal structure 1310. Segments 1320 can have supports 1322 such as channels or lumens. In some cases, one or more segments may not include a support. Toy 1300 also includes a light assembly 1340. As shown here, light assembly 1340 can include one or more light emitting elements 1344 that emit light 1348. Light emitting element 1344 may include, for example, a glowstick or lightstick. Such light emitting elements typically include chemicals that are capable of producing light through chemoluminescence. An exemplary glowstick includes an outer plastic tube that holds a fluorescent dye, a derivate of phenyl oxalate ester, and an inner breakable glass vial containing hydrogen peroxide. In use, an operator can bend the outer plastic tube which in turn breaks the inner vial, thus allowing the hydrogen peroxide to react with the phenyl oxalate ester. Energy released from this reaction excites the dye, and the excited dye releases light. The color of the emitted light is determined by the dye structure. A glowstick can have any desired shape.

Figure 13A:
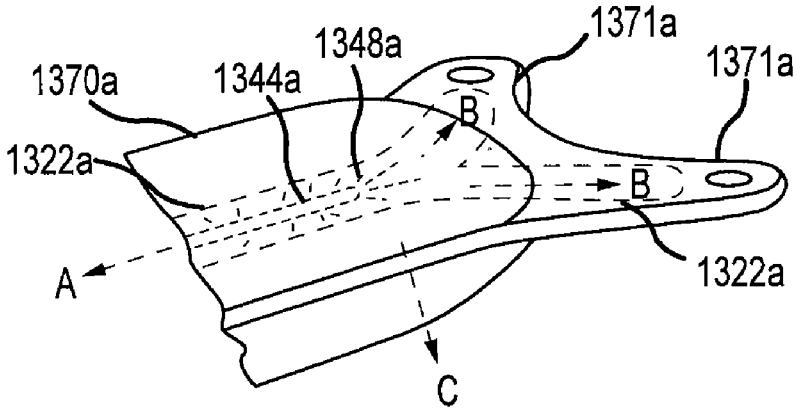
Figure 13B:
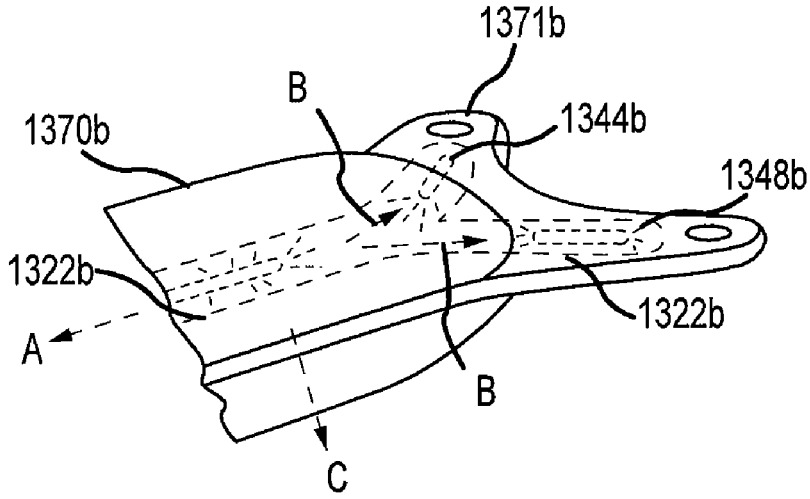

As shown here, skeletal structure 1310 can be constructed from a first portion 1314 and a second portion 1316. These portions may be coupled together in any of a variety of ways. For example, first portion 1314 can include a plurality of receptacles 1315, and second portion 1316 can include a plurality of posts 1317 that are adapted to insert into receptacles 1315. In some embodiments, first portion 1314 and second portion 1316 represent two generally hemigeodesic or semigeodesic components, which form a skeletal structure 1310 having a geodesic shape when coupled together. Toy 1300 also includes a platform 1370 configured to support or hold light assembly 1340. As shown here, platform 1370 can include a removable cap 1373, such as a snap lid. Platform 1370 can include supports 1322 such as channels or lumens. Platform 1370 can be coupled with skeletal structure 1310 as desired. For example, platform 1370 can include one or more struts 1371 that attach with skeletal structure 1310. Optionally, struts 1371 may include one or more apertures 1372 which are adapted to receive posts 1317 therethrough. In some cases, a platform can be constructed of one or more pieces. For example, platform 1370 is depicted here as a composite structure that includes platform top bracket 1370*i* and platform bottom bracket 1370*ii*. As shown in FIG. 13A, a light emitting element 1344*a* can be disposed within, or positioned to direct light 1348*a* into, a support 1322*a* such as a channel or lumen of a platform 1370*a*. Light emitting element 1344*a* can also transmit light 1348*a* into or toward a support 1322*a* such as a channel or lumen of a strut 1371*a*. For example, support 1322*a* of platform 1370*a* can transmit light 1348*a*, as indicated by arrow A, and supports 1322*a* of struts 1371*a* can transmit light 1348*a*, as indicated by arrows B. Light emitting element 1344*a* can also direct or project light as indicated by arrow C beyond a support 1322*a*, platform 1370*a*, or struts 1371*a*, toward or onto a skeletal structure, or through an aperture in a skeletal structure toward an ambient space or environment. In some cases, a light emitting element 1344*b* can be disposed within, and configured to direct light 1348*b* into, a support 1322*b* such as a channel or lumen of a strut 1371*b*, as shown in FIG. 13B. Relatedly, light emitting element 1344*b* can be disposed within support 1322*b* of strut 1371*b*, and configured to direct or transmit light toward or within support 1322*b* of platform 1370*b*. For example, support 1322*b* of platform 1370*b* can transmit light 1348*b*, as indicated by arrow A, and supports 1322*b* of struts 1371*b* can transmit light 1348*b*, as indicated by arrows B. Light emitting element 1344*b* can also direct or project light as indicated by arrow C beyond a support 1322*b*, platform 1370*b*, or struts 1371*b*, toward or onto a skeletal structure, or through an aperture in a skeletal structure toward an ambient space or environment.

Figure 14:
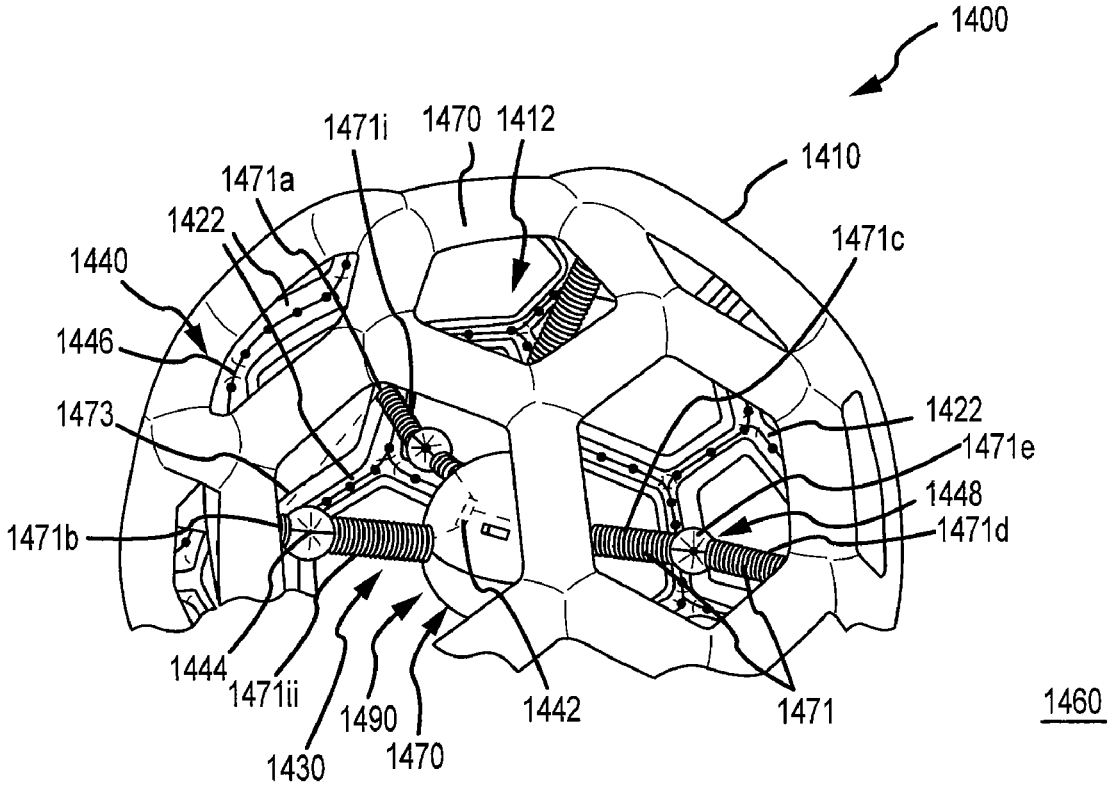
FIG. 14 shows aspects of a toy according to embodiments of the present invention.

FIG. 14 illustrates additional features of a core module or interior support module, according to embodiments of the present invention. Toy 1400 includes a skeletal structure 1410 coupled with a core module 1490. As shown here, core module 1490 includes a platform 1470 and a plurality of struts 1471. Struts 1471 can be configured in any of a variety of three dimensional orientations. For example, a first strut may be aligned along a X-axis, a second strut may be aligned along a Y-axis, and a third strut may be aligned along a Z-axis. A strut can impart tensile strength to a skeletal structure. Skeletal structure 1410, core module platform 1470, core module strut 1471, or any combination thereof, may include one or more supports 1422 such as channels or lumens. In some cases, a strut support may be in continuous communication with a skeletal structure support, so that light transmitted through the strut support can travel into the skeletal structure support, and light transmitted through the skeletal structure support can travel into the strut support. Core module 1490 can be coupled with skeletal structure 1470, such that a first strut 1471*i* of core module 1490 is coupled with skeletal structure 1470 at a first location 1471*a*, and a second strut 1471*ii* of core module 1490 is coupled with skeletal structure 1470 at a second location 1471*b*. First location 1471*a* and second location 1471*b* can be connected by a line 1473, such that the line represents a chord. As shown here, such a line or chord passes through the interior of the skeletal structure.

Skeletal structure 1410 of toy 1400 defines an open interior cavity 1430. Typically, open interior cavity 1430 is in fluid communication with an ambient space or environment 1460 disposed outside of the toy. As such, at some locations the skeletal structure itself may provide a separation or boundary between interior cavity 1430 and ambient space 1460, whereas in other places there may be no physical barrier provided by the skeletal structure between the cavity and the ambient space. Optionally, open interior cavity 1430 may be in fluid communication with ambient space 1460 via a plurality of apertures 1412 which are defined by skeletal structure 1410. Skeletal structure 1410 can have supports 1422 such as channels or lumens. As shown here, toy 1400 also includes a light assembly 1440 having a power source 1442 and a plurality of light emitting diodes (LEDs) 1444. Light assembly 1440 includes a wire or conducting element 1446 that conducts electricity between power source 1442 and LEDs 1444. Light assembly 1440 can be configured to direct light 1448 into a plurality of supports 1422.

In some embodiments, one or more struts 1471 may include an accordion configuration. As depicted here, a strut 1471 may include an inner segment 1471*c*, an outer segment 1471*d*, and a housing segment 1471*e* disposed between the inner and outer segments. In some cases, housing segment 1471 can be configured to house a light emitting element. Struts and housing elements may also include supports such as lumens, channels, passages, and the like, configured to house or contain various components of a light assembly, including light emitting elements, wires, processors, energy source holders, energy sources, and the like.

Figures 1, 15A:
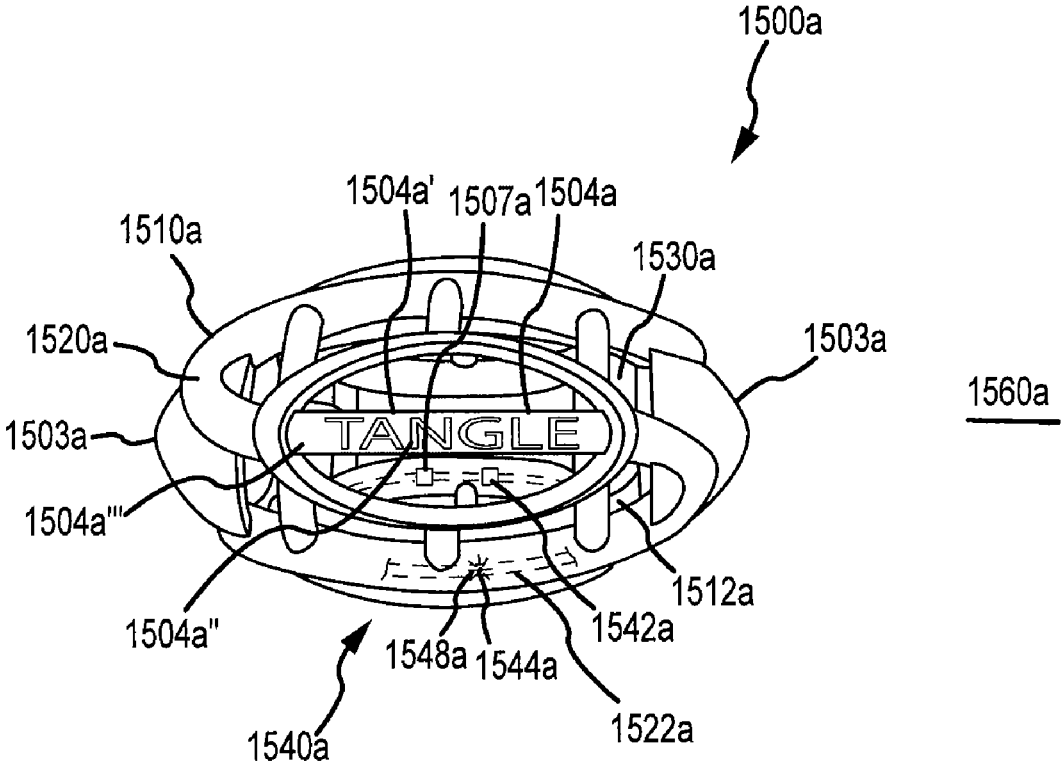
Figures 2, 15A:
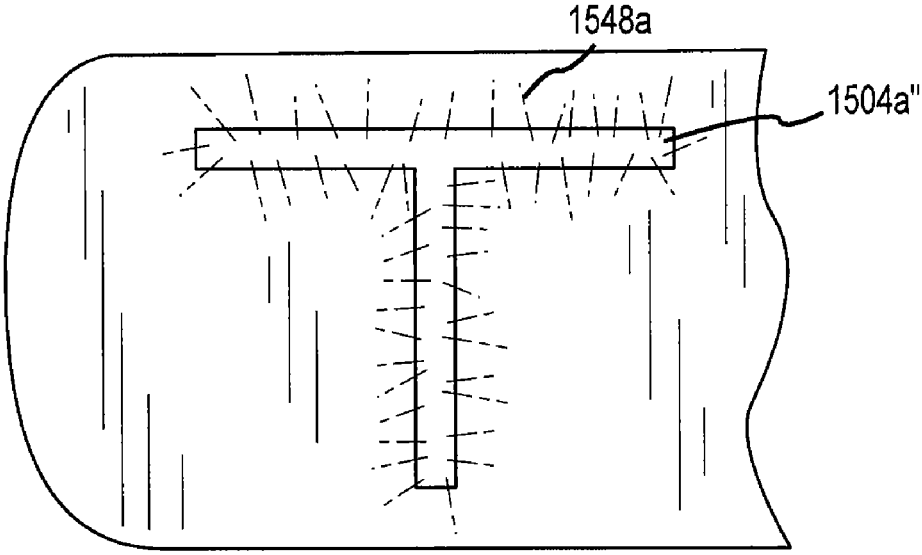

FIG. 15A-1 illustrates a toy according to embodiments of the present invention. Toy 1500*a* includes a skeletal structure 1510*a* having a plurality of segments 1520*a*. Skeletal structure 1510*a* defines an open interior cavity 1530*a*. In some embodiments, open interior cavity 1530*a* is in fluid communication with an ambient space 1560*a* disposed outside of the toy. Optionally, open interior cavity 1530*a* may be in fluid communication with ambient space 1560*a* via a plurality of apertures 1512*a* defined by skeletal structure 1510*a*. Segments 1520*a* can have supports 1522*a* such as channels or lumens. In some cases, one or more segments may not include a support. Toy 1500*a* also includes a light assembly 1540*a*. Optionally, light assembly may include a power source 1542*a*, such as one or more button cell batteries, and a PC board or processor 1507*a* which contains a tangible medium embodying machine-readable code for controlling activation of the light emitting elements. Light assembly 1540*a* includes one or more light emitting elements 1544*a* that emit light 1548*a*. In some cases, light emitting element 1544*a* may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1540*a* may also includes one or more wires that conduct electricity between power source 1542*a* and light emitting element 1544*a*.

Skeletal structure 1510*a* can present a prolate spheroid shape, such as an American football shape. Toy 1500*a* can also include end caps 1503*a* and a logo plate 1504*a* which can be coupled with skeletal structure 1510*a*. Toy 1500*a* also includes a light assembly 1540*a* that can transmit light toward, onto, or through supports 1522*a* such as channels or lumens. Toy 1500*a* may also include platform and strut assemblies, as described elsewhere herein. As shown here, logo plate 1504*a* includes a contour 1504*a*' and a plurality of apertures 1504*a*", and is configured to present a shaped outline, template, or silhouette of a logo or other graphic element. The logo or other graphic element can represent any of a variety of companies, brand names, groups, projects, persons, organizations, or any other desired organization, item, devices, process, or the like. As shown here, the combination of the contour and apertures can provide a stylized type, either alone or in conjunction with a graphic representation. Toy 1500*a* is configured so that light transmitted from or emitted by various light emitting elements can pass through apertures 1504*a*", or along the outer edges of contour 1504*a*'. In this way, toy 1500*a* can present a variety of light presentations to an toy operator or user, or to any observer. For example, light passing through apertures 1504*a*" can provide or present one or more light beams, where the shape of each light beam corresponds to the shape of the individual aperture though which that beam passes, so as to present a toy operator with an image of the word "TANGLE". Optionally, logo plate 1504*a* can include supports within the body 1504*a*'" of the logo plate, and the supports can transmit light in such a way that light emitted from the body 1504*a*'" presents a toy operator with an inverse image of the word "TANGLE". FIG. 15A-2 shows that light 1548*a* can pass through aperture 1504*a*', so as to present a viewer with a lighted image or beam having a shape that corresponds to the shape of the aperture.

Figures 1, 15B:
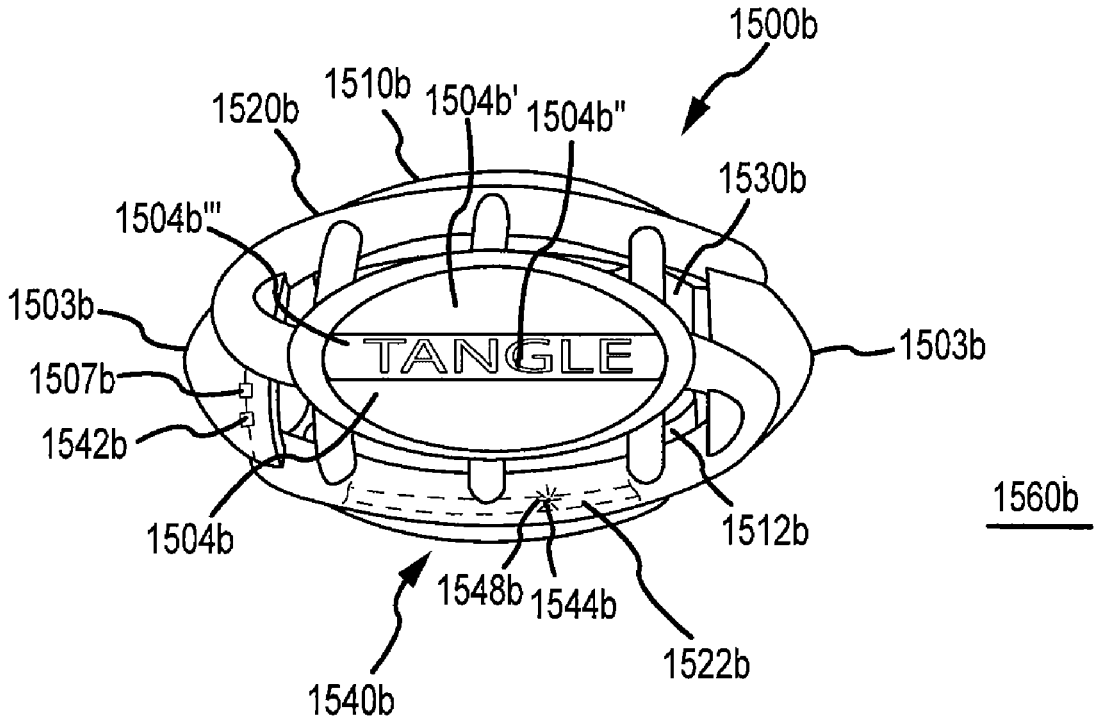
Figures 2, 15B:
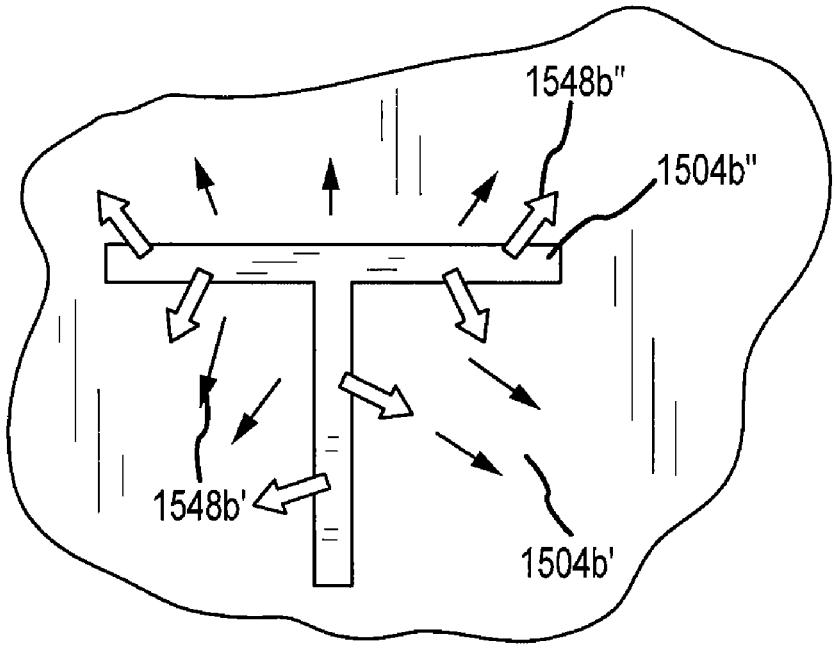

FIG. 15B-1 illustrates a toy according to embodiments of the present invention. Toy 1500*b* includes a skeletal structure 1510*b* having a plurality of segments 1520*b*. Skeletal structure 1510*b* defines an open interior cavity 1530*b*. In some embodiments, open interior cavity 1530*b* is in fluid communication with an ambient space 1560*b* disposed outside of the toy. Optionally, open interior cavity 1530*b* may be in fluid communication with ambient space 1560*b* via a plurality of apertures 1512*b* defined by skeletal structure 1510*b*. Segments 1520*b* can have supports 1522*b* such as channels or lumens. In some cases, one or more segments may not include a support. Toy 1500*b* also includes a light assembly 1540*b*. Optionally, light assembly may include a power source 1542*b*, such as one or more button cell batteries, and a PC board or processor 1507*b* which contains a tangible medium embodying machine-readable code for controlling activation of the light emitting elements. Light assembly 1540*b* includes one or more light emitting elements 1544*b* that emit light 1548*b*. In some cases, light emitting element 1544*b* may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1540*b* may also includes one or more wires that conduct electricity between power source 1542*b* and light emitting element 1544*b*.

Skeletal structure 1510*b* can present a prolate spheroid shape, such as an American football shape. Toy 1500*b* can also include end caps 1503*b* and a logo plate 1504*b* which can be coupled with skeletal structure 1510*b*. Toy 1500*b* also includes a light assembly 1540*b* that can transmit light toward, onto, or through supports 1522*b* such as channels or lumens. Toy 1500*b* may also include platform and strut assemblies, as described elsewhere herein. As shown here, logo plate 1504*b* includes a first portion 1504*b*' and a plurality of second portions 1504*b*", and is configured to present a shaped outline, template, or silhouette of a logo or other graphic element. The logo or other graphic element can represent any of a variety of companies, brand names, groups, projects, persons, organizations, or any other desired organization, item, devices, process, or the like. As shown here, the combination of the first portion and the second portions can provide a stylized type, either alone or in conjunction with a graphic representation. Toy 1500*b* is configured so that light transmitted from or emitted by various light emitting elements can pass through first portion 1504*b*', or through second portions 1504*b*". In some cases, first or second portions may include transparent or translucent materials, optionally colored, through which light may pass. In some cases, first or second portions may include opaque materials, through which light may not pass. In this way, toy 1500*b* can present a variety of light presentations to an toy operator or user, or to any observer. For example, light passing through second portions 1504*b*" can provide or present one or more light beams or projections, where the shape of each light beam or projection corresponds to the shape of the individual portion though which that light passes, so as to present a toy operator with an image of the word "TANGLE". Optionally, logo plate 1504*b* can include supports within the body 1504*b*'" of the logo plate, and the supports can transmit light in such a way that light emitted from the body 1504*b*'" presents a toy operator with an inverse image of the word "TANGLE". FIG. 15B-2 shows that light 1548*b*' can pass through first portion 1504*b*', so as to present a viewer with a lighted image or beam having a shape that corresponds to the shape of first portion 1504*b*', and light 1548*b*" can pass through second portion 1504*b*", so as to present a viewer with a lighted image or beam having a shape that corresponds to the shape of second portion 1504*b*". Light 1548*b*' and light 1548*b*" typically differ in intensity, color, hue, temperature, value, saturation, luminosity, or any other light characteristic, so that a viewer can discriminate between light passing through first portion 1504*b*', and light passing through second portion 1504*b*".

Figures 1, 15C:
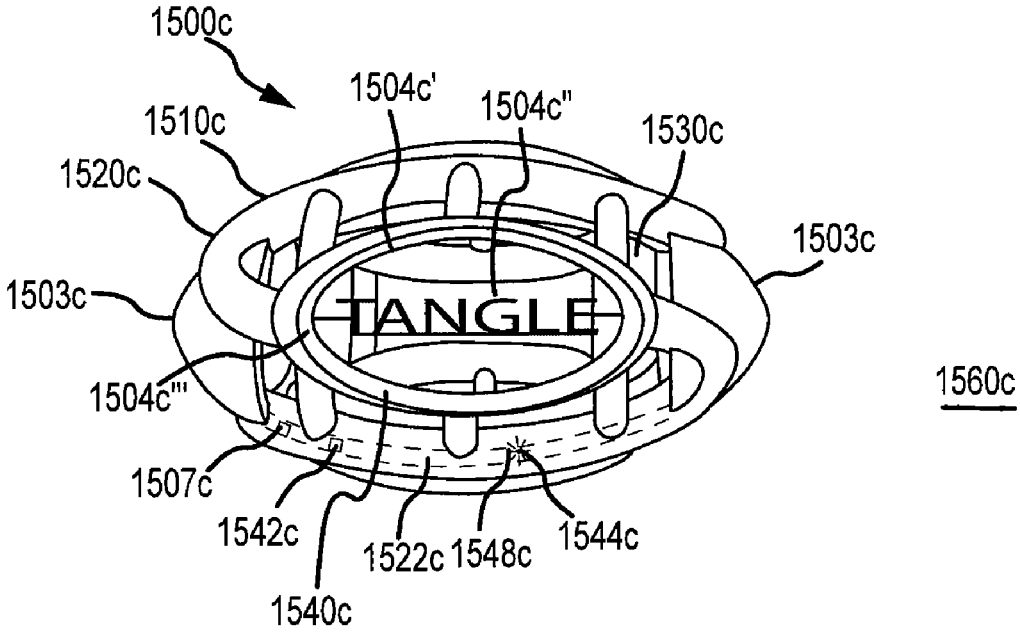
Figures 2, 15C:
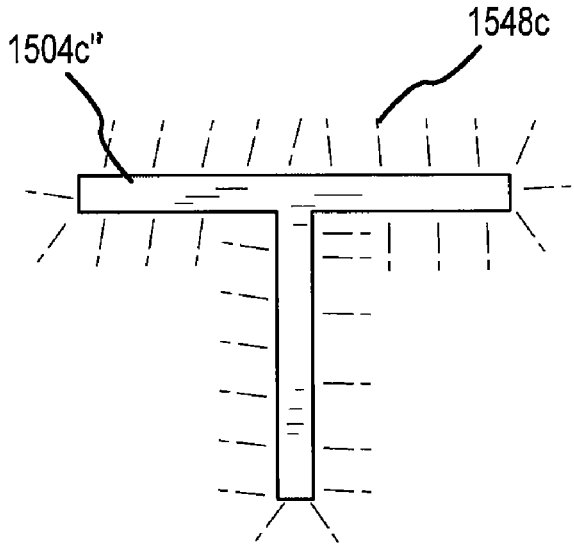

FIG. 15C-1 illustrates a toy according to embodiments of the present invention. Toy 1500*c* includes a skeletal structure 1510*c* having a plurality of segments 1520*c*. Skeletal structure 1510*c* defines an open interior cavity 1530*c*. In some embodiments, open interior cavity 1530*c* is in fluid communication with an ambient space 1560*c* disposed outside of the toy. Optionally, open interior cavity 1530*c* may be in fluid communication with ambient space 1560*c* via a plurality of apertures 1512*c* defined by skeletal structure 1510*c*. Segments 1520*c* can have supports 1522*c* such as channels or lumens. In some cases, one or more segments may not include a support. Toy 1500*c* also includes a light assembly 1540*c*. Optionally, light assembly may include a power source 1542*c*, such as one or more button cell batteries, and a PC board or processor 1507*c* which contains a tangible medium embodying machine-readable code for controlling activation of the light emitting elements. Light assembly 1540*c* includes one or more light emitting elements 1544*c* that emit light 1548*c*. In some cases, light emitting element 1544*c* may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1540*c* may also includes one or more wires that conduct electricity between power source 1542*c* and light emitting element 1544*c*.

Skeletal structure 1510*c* can present a prolate spheroid shape, such as an American football shape. Toy 1500*c* can also include end caps 1503*c* and a logo plate 1504*c* which can be coupled with skeletal structure 1510*c*. Toy 1500*c* also includes a light assembly 1540*c* that can transmit light toward, onto, or through supports 1522*c* such as channels or lumens. Toy 1500*c* may also include platform and strut assemblies, as described elsewhere herein. As shown here, logo plate 1504*c* includes a contour 1504*c*' and a plurality of filters 1504*c*", and is configured to present a shaped outline, template, or silhouette of a logo or other graphic element. In some cases, a filter may include transparent or translucent materials, optionally colored, through which light may pass. In some cases, a filter may include opaque materials, through which light may not pass. The logo or other graphic element can represent any of a variety of companies, brand names, groups, projects, persons, organizations, or any other desired organization, item, devices, process, or the like. As shown here, the combination of the contour and filters can provide a stylized type, either alone or in conjunction with a graphic representation. Toy 1500*c* is configured so that light transmitted from or emitted by various light emitting elements can pass through filters 1504*c*", or along the edges of contour 1504*c*'. In this way, toy 1500 can present a variety of light presentations to an toy operator or user, or to any observer. For example, light passing through filters 1504*c*" can provide or present one or more light beams, where the shape of each light beam corresponds to the shape of the individual aperture though which that beam passes, so as to present a toy operator with an image of the word "TANGLE". Optionally, logo plate 1504 can include supports within the body 1504*c*'" of the logo plate, and the supports can transmit light in such a way that light emitted from the body 1504*c*'" presents a toy operator with an inverse image of the word "TANGLE". In some cases, a filter 1504*c*" may include a support having lighting assembly elements contained therein. FIG. 15C-2 shows that light 1548*c* can pass along the edge of filter 1504*c*', so as to present a viewer with an lighted image or beam having a shape that corresponds to the inverse shape of the filter.

Figure 16A:
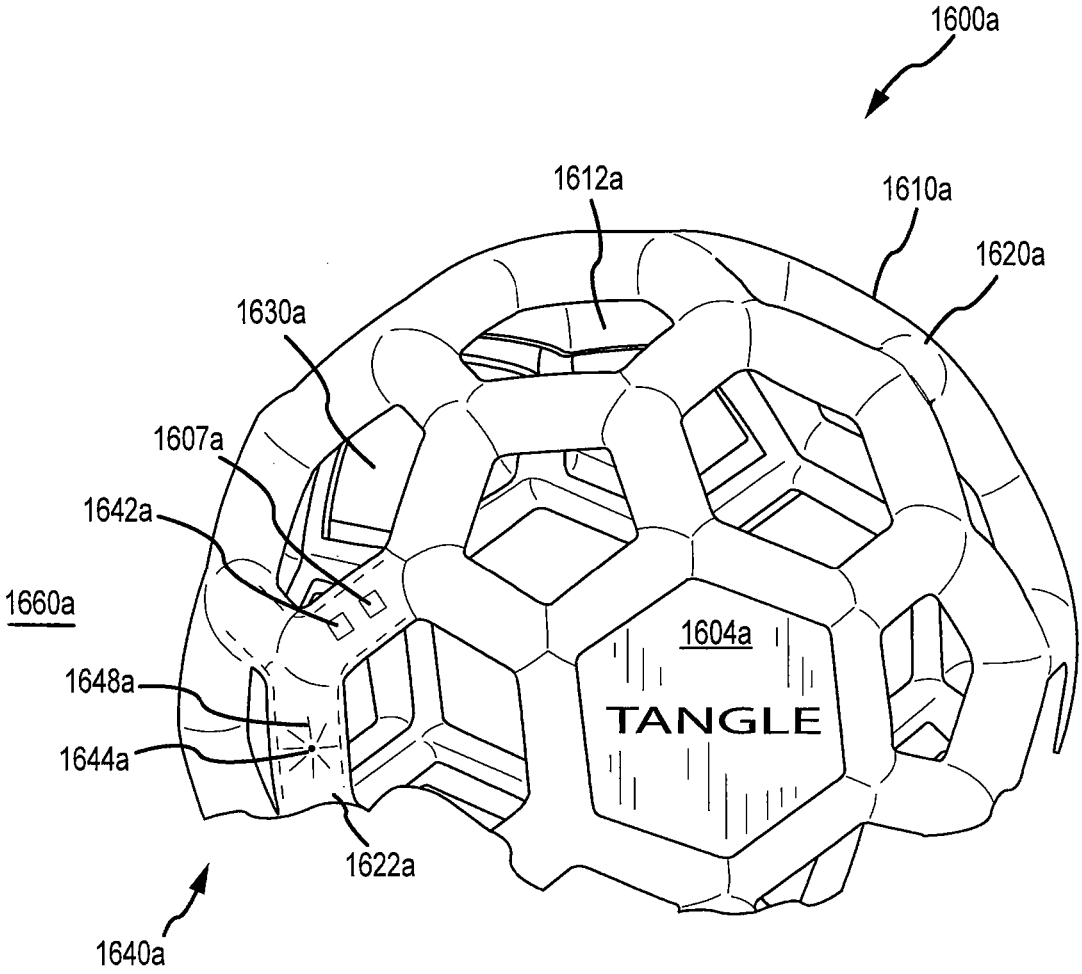
FIGS. 16A and 16B show aspects of toys according to embodiments of the present invention.

FIG. 16A illustrates a toy according to embodiments of the present invention. Toy 1600*a* includes a skeletal structure 1610*a* having a plurality of segments 1620*a*. Skeletal structure 16510*a* defines an open interior cavity 1630*a*. In some embodiments, open interior cavity 1630*a* is in fluid communication with an ambient space 1660*a* disposed outside of the toy. Optionally, open interior cavity 1630*a* may be in fluid communication with ambient space 1660*a* via a plurality of apertures 1612*a* defined by skeletal structure 1610*a*. Segments 1620*a* can have supports 1622*a* such as channels or lumens. In some cases, one or more segments may not include a support. Toy 1600*a* also includes a light assembly 1640*a*. Optionally, light assembly may include a power source 1642*a*, such as one or more button cell batteries, and a PC board or processor 1607*a* which contains a tangible medium embodying machine-readable code for controlling activation of the light emitting elements. Light assembly 1640*a* includes one or more light emitting elements 1644*a* that emit light 1648*a*. In some cases, light emitting element 1644*a* may include a light emitting diode (LED), an organic light emitting diode (OLED), or the like. Similarly, light emitting element may include a fluorescent or incandescent light. A light emitting element may emit light radiation at any of a variety of wavelengths. For example, a light emitting element may emit infrared, visible, or ultraviolet light. Light assembly 1640*a* may also includes one or more wires that conduct electricity between power source 1642*a* and light emitting element 1644*a*.

Figure 16B:
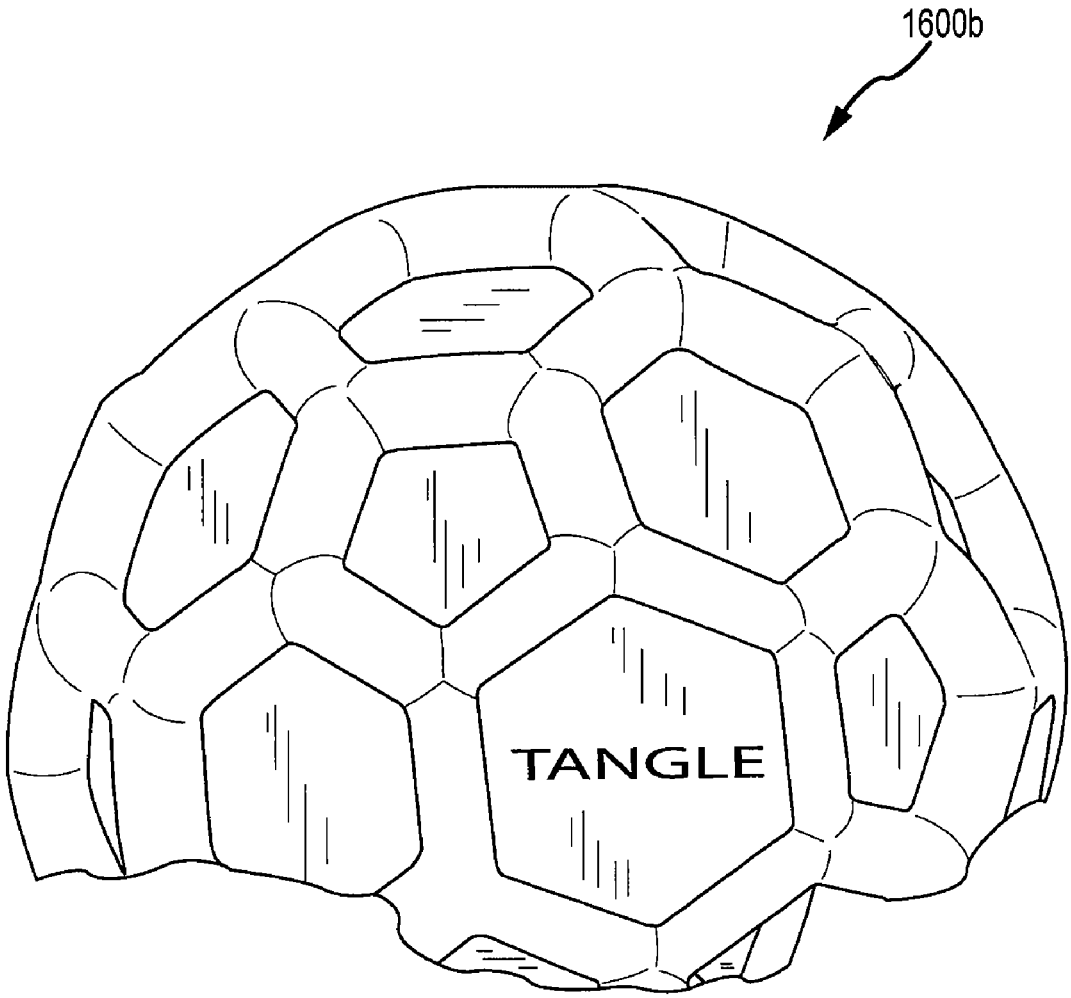

Skeletal structure 1610*a* can present a spherical or geodesic shape, such as an American soccer ball shape. Toy 1600*a* can also include a logo plate or sheath 1604*a* which can be coupled with skeletal structure 1610*a*. Toy 1600*a* also includes a light assembly 1640*a* that can transmit light toward, onto, or through supports 1622*a* such as channels or lumens. Toy 1600*a* may also include platform and strut assemblies, as described elsewhere herein. As shown here, logo plate or sheath 1604*a* can include any combination of contours, apertures, portions, filters, and the like, as discussed with regard to FIGS. 15A-15C. Optionally, toy 1600*a* may include a sheath that covers all or part of a single aperture 1612*a*. Similarly, toy 1600*a* may include multiple sheaths that cover multiple apertures. As shown in FIG. 16B, toy 1600*b* can include multiple sheaths, where each aperture of the toy is covered by a sheath. Advantageously, such logo plates, sheaths, or patches can be particularly useful as an advertising, educational, or informational medium. They may include solid and translucent or transparent elements, so as to selectively allow various amounts or colors of light to transmit through specific locations on the plate, patch, or sheath. These elements can also include cut-outs or apertures where light can directly pass. Relatedly, these elements can be designed to display text or other shapes.

Skeletal structures, segments, struts, platforms, logo plates, sheaths, and other toy elements described herein may be made of any of a variety of materials. In some embodiments, one or more such elements of a toy may include a durable thermoplastic resin (TPR). For example, a toy may include a skeletal structure with a thermoplastic resin having a durometer or hardness value of about 60. It has been discovered that toy embodiments of the present invention provide desired bounce characteristics not found in commonly available toy balls. Exemplary toy embodiments present improved bounceability and resiliency profiles. Bounceability can be characterized, for example, by how high a toy bounces, and how many times the toy bounces, when the toy is dropped from a distance. Resiliency can relate to how much energy is stored in the toy when the toy deforms, and subsequently relaxes, upon bouncing. Toy embodiments of the present invention, when dropped from a distance, can bounce highly and for a long period of time, even when dropped from a short distance. In some embodiments, the incorporation of struts into a toy can enhance or modulate the bounceability or resistance of the toy. In related embodiments, the incorporation of logo plates, patches, or sheaths can enhance or modulate the bounceability or resistance of the toy. In some cases, the bounceability can be modulated by the number of plates, patches, or sheaths on the toy, or by the hardness or elasticity of these elements. According to some embodiments, when a ball is dropped from a height of six feet, it bounces back to a height of at least three feet.

According to embodiments of the present invention, interior structural elements or support modules, such as platforms and struts, can be flexible or depressible. In this way, these interior platforms and struts can provide resilience or deformability to the overall structure of the toy, and the toy structure can bounce. For example, the toy can be thrown against or dropped upon a surface, and spring back or rebound in a lively fashion. Often, an interior or core support module, which may include one or more struts and optionally one or more platforms, can be disposed within the skeletal structure so that it resides at the center of gravity of the toy. An interior support module may include any desired number of struts disposed in any desired orientation. Light from a light emitting element can be transmitted along any desired light path. For example, light can be transmitted from a platform support channel, through a strut support channel, and into a skeletal segment support channel.

In some embodiments, toys may include a processor or light module CPU that controls a light assembly of the toy. A processor or CPU of the toy can also be configured to contain data or information that can be emitted through small speakers in the toy. The toy may also include positional or motion sensors, accelerometers, and the like. The toy can include a data storage medium for storing data from such sensors. The processor can be configured to access such data, and to also include voice recognition processing elements. For example, a processor can be programmed to recognize a question spoken by the toy user, such as "Ball, how many feet did you go?" The processor can be programmed to calculate a traveled distance, and to emit the answer in an audible format via the speakers. Optionally, a processor can be programmed to recognize spoken statistical questions, and to process such questions by accessing a statistical database. Hence, a user can ask the toy "Ball, who won the Soccer World Cup in 1966?" and the processor controls the speakers to emit the answer in an audible fashion.

Embodiments of the present invention provide toys with skeletal structures and boundary envelopes having any of a variety of shapes. For example, such shapes may include spheres, spheroids, prolate spheroids, oblate spheroids, ellipsoids, toroids, geodesic spheres, and the like. Toys may be shaped as any desired useful or functional object, including without limitation bats, balls, lawn lacrosse stick nets, bowling balls, hockey sticks and pucks, flying discs, basketballs, basketball nets, soccer balls, soccer nets, paddles, rackets, paddles with tethered balls, lawn darts, pool toys, dive toys, bulls eye hoops, lariats, stationary and school supplies, lunch pails, cups, pet toys, teething toys, toddler toys, sandbox toys, puzzles, games, bag danglers, bag clips, drink cozies, sandals, and the like.

Skeletal structures, light assemblies, or portions thereof may be constructed of or include in-molded sections of any desired material. Exemplary materials, include soft touch paint, molded textures that match retail features such as leather patterns, glow in the dark plastics, glitter material, scented plastics, multi-colored plastics, metallic finishes, in mold decoration (IMD) graphics, and the like. Skeletal structures, segments, and other aspects of toy embodiments may include features described in U.S. Pat. Nos. 4,509,929, 5,110,315, 6,086,445, and 7,192,328, and in U.S. patent application Ser. Nos. 11/015,387 filed Dec. 16, 2004, 11/152,020 filed Jun. 13, 2005, and 11/558,350 filed Nov. 9, 2006. The content of each of these filings is incorporated herein by reference.

Toys may include auxiliary features combined with or integrated with the skeletal structures or light assemblies. For example, a toy can include a sound device or an internal ball or structure. In some cases, light assemblies, sound devices, and other toy features may be motion-activated. For example, such toy features may be activated when the entire body of the toy is moved or translated in any direction in three dimensions. Relatedly, such toy features may be activated when the body of the toy is compressed or deformed. Toys may include motions sensors that detect motion, or compression or stress sensors that detect deformation.

In some embodiments, one or more toy segments may be coupled with or incorporate a writing instrument or other tool, or may include a therapeutic element or surface, as described in previously incorporated U.S. patent application Ser. No. 11/152,020 filed Jun. 13, 2005. For example, a toy segment may include or be coupled with a ball point pen, retractable pen, pencil, colored pencil, charcoal pencil, mechanical pencil, fountain pen, dip pen, quill pen, paint brush, gel pen, marker, highlighter, stylographs, crayon, and the like. Similarly, therapeutic elements may include resilient coatings, rotatable or slidable elements on the surface of the segments, heating or cooling of the segments, vibratable elements, encased gels or liquids, various textured surfaces, colors and/or lights, varying sizes, thicknesses and/or levels of resilience, therapeutic magnets, surfaces that move up and down or in and out, various natural or synthetic materials, such as fabrics, leather, features, fibers, seeds, other plants and the like, scented materials, herbs, flavored materials, sticky surfaces, raised or lowered images (including brail), lotions, ointments, medicines, lubricants, sponges, porous materials, foams, rubbers, bendable tabs, extensions, spikes, clays or putty, electrical stimulation elements, and the like. Segments can also be configured as a holder for a writing instrument body. In some cases, the segments can be arranged so as to prop the writing instrument body at an angle, disposed above the desk. Alternatively, the segments can be arranged so as to support the writing instrument body in a horizontal position on the desk. In related cases, the segments will be easily removable or detachable so that if the user does not want the segments on the toy body, he or she can simply pull them off or otherwise disconnect them. Toy segments can be fabricated from or include any of a variety of desired materials, such as metals, polymers, and natural substances such as wood or bamboo. Segments may be hollow, solid, porous, fibrous, and the like. Segments can include a rubber coating, a rubber coating with raised nodules, a silicone gel coating, a chemical composite coating, or a compressible rubber coating. In some cases, the segments can include or be coated with materials of varying hardness, including thermoplastic rubber, synthetic rubber, and the like. Embodiments of the present invention encompass stress relief devices, performance balls, and pet toys. In some cases, embodiments include baby toys for grasping and teething.

Although certain system, device, and method embodiments have been disclosed herein, it will be apparent from the foregoing disclosure to those skilled in the art that variations, modifications, alternative constructions, and equivalents of such embodiments may be made without departing from the true spirit and scope of the invention. Therefore, the above description should not be taken as limiting the scope of the invention which is defined by the appended claims.

What is claimed is:

1. A bounceable ball toy, comprising:

a light assembly having a power source and a plurality of light emitting diodes;

a first end cap;

a second end cap; and a spherical skeletal structure having a plurality of curved loop segments which form a continuous loop, the spherical skeletal structure defining an open interior cavity and having a first end and a second end, wherein each curved loop segment has a curved end and an opposite end, wherein the curved end of each loop segment is coupled with the first end cap at the first end of the spherical skeletal structure, wherein the opposite end of each loop segment is coupled with the second end cap at the second end of the spherical skeletal structure, wherein at least some segments of the skeletal structure comprise a channel opening that faces toward the interior cavity, wherein the light assembly extends between adjacent skeletal structure segment channels, and wherein the light emitting diodes are disposed at least partially within the channel openings.

2. The bounceable ball toy of claim 1, wherein the spherical skeletal structure defines at least two apertures that provide fluid communication between the open interior cavity and an ambient space disposed outside of an external boundary defined by the skeletal structure.

3. The bounceable ball toy of claim 1, wherein the light assembly is configured to direct light toward a surface of the channel opening.

4. The bounceable ball toy of claim 1, wherein at least some of the segments comprise a portion that is transparent or translucent to light.

5. The bounceable ball toy of claim 1, wherein the light assembly comprises a wire that is disposed at least partially within the channel openings.

6. A bounceable ball toy, comprising:

a light assembly; and a skeletal structure having a plurality of curved loop segments which collectively form a single continuous loop, the skeletal structure defining an open interior cavity and having a first end and a second end, wherein each curved loop segment has a curved end and an opposite end, wherein the curved end of each loop segment meets at the first end of the skeletal structure without intersecting, wherein the opposite end of each loop segment meets at the second end of the skeletal structure without intersecting, wherein the single continuous loop of the skeletal structure provides a single continuous non-intersecting central longitudinal axis extending coaxially within each of the curved loop segments, wherein at least some segments of the skeletal structure comprise a channel opening that faces toward the interior cavity, wherein the light assembly extends between adjacent skeletal structure segment channels, and wherein the light assembly is disposed at least partially within the channel openings.

7. A toy, comprising:

a light assembly; and a skeletal structure having a curved loop segment that forms a single continuous loop, the skeletal structure defining an open interior cavity and having a first end and a second end, wherein the curved loop segment has at least three curved ends and at least three opposite ends, wherein each curved end of the loop segment meets at the first end of the skeletal structure without intersecting, wherein each opposite end of the loop segment meets at the second end of the skeletal structure without intersecting, wherein at least some segments of the skeletal structure comprise a channel opening that faces toward the interior cavity, wherein the light assembly extends between adjacent skeletal structure segment channels, and wherein the light assembly is disposed at least partially within the channel openings.

8. The toy of claim 7, wherein the light assembly comprises a light emitting diode or a glowstick.

9. The toy of claim 7, wherein the skeletal structure defines two or more apertures that provide fluid communication between the open interior cavity and an ambient space disposed outside of an external boundary defined by the skeletal structure.

10. The toy of claim 7, wherein the skeletal structure defines a shape selected from the group consisting of a sphere, a spheroid, a prolate spheroid, an oblate spheroid, an ellipsoid, a toroid, and a geodesic sphere.

11. The toy of claim 7, wherein the light assembly comprises a processor.

12. The toy of claim 7, wherein the skeletal structure is coupled with a logo plate comprising a filter or an aperture.

13. The toy of claim 7, wherein the skeletal structure comprises a thermoplastic resin having a durometer of about 60.

* * * * *